US005995774A

United States Patent [19]

Applegate et al.

[11] Patent Number: 5,995,774

[45] Date of Patent: Nov. 30, 1999

[54] METHOD AND APPARATUS FOR STORING DATA IN A NON-VOLATILE MEMORY CIRCUIT MOUNTED ON A PRINTER'S PROCESS CARTRIDGE

[75] Inventors: Steven Lewis Applegate; Cyrus Bradford Clarke, both of Lexington; Timothy Philip Craig, Georgetown; David Lee Merrifield, Lexington; James John Molloy, Lexington; Benjamin Keith Newman, Lexington; Gary Scott Overall, Lexington; Gregrory Lawrence Ream, Lexington; Thomas Gregrory Survant, Lexington; Thomas Campbell Wade, Lexington; Phillip Byron Wright, Lexington, all of Ky.

[73] Assignee: Lexmark International, Inc., Lexington, Ky.

[21] Appl. No.: 09/152,241

[22] Filed: Sep. 11, 1998

[51] Int. Cl.[6] ..... G03G 15/08

[52] U.S. Cl. ..... 399/27

[58] Field of Search ..... 399/24, 27, 30, 399/53, 61, 62, 63, 64, 107, 110, 111, 119

[56] References Cited

U.S. PATENT DOCUMENTS

| | | |
|---|---|---|
| 4,074,798 | 2/1978 | Berger . |
| 4,322,813 | 3/1982 | Howard et al. . |
| 4,500,195 | 2/1985 | Hosono . |
| 4,551,000 | 11/1985 | Kanemitsu et al. . |
| 4,583,834 | 4/1986 | Seko et al. . |
| 4,585,327 | 4/1986 | Suzuki . |
| 4,586,147 | 4/1986 | Tadokoro . |
| 4,611,899 | 9/1986 | Kasamura et al. . |
| 4,626,096 | 12/1986 | Ohtsuka et al. . |
| 4,634,258 | 1/1987 | Tanaka et al. . |
| 4,638,457 | 1/1987 | Schrenk . |
| 4,639,116 | 1/1987 | Fukae et al. . |

(List continued on next page.)

FOREIGN PATENT DOCUMENTS

| | | |
|---|---|---|
| 0 770 936 A1 | 5/1997 | European Pat. Off. . |
| 58-132758 | 8/1983 | Japan . |
| 60-083046 | 5/1985 | Japan . |

(List continued on next page.)

*Primary Examiner*—Sandra Brase
*Attorney, Agent, or Firm*—John A. Brady

[57] ABSTRACT

An improved electrophotographic (EP) printer is provided having a detachable process cartridge that contains a non-volatile memory device, which is an EPROM that cannot be erased after a bit is burned. A "toner wheel" mounted to the exterior of the toner reservoir of the process cartridge provides, in conjunction with an optoelectronic sensor, an electrical signal that the printer receives and uses to determine toner usage. A toner "gas-gauge" is created which uses "bucket levels" as discrete steps to indicate how much of the measured physical toner material actually remains within the toner reservoir. After a given amount of toner material has been dispensed through the developer unit, one of the bits of the EPROM memory device is irreversibly burned, thereby providing a permanent record on the process cartridge of a certain amount of toner usage. As with a normal automobile gas gauge, the toner gas-gauge reading should never increase unless the amount of toner material inside the toner reservoir has increased. Once the bucket level transitions begin to occur for the toner gas-gauge, the printer becomes aware that a majority of the toner material has been expended from inside the toner reservoir. If the number of bucket gradation levels then increases by more than the hysteresis amount, then the printer will "lock out" the operation of a non-reusable process cartridge. When the lock-out mode occurs, a particular bit is burned on the EPROM mounted to the cleaner housing of the process cartridge. This ensures that this particular process cartridge cannot be removed, then simply placed back into the same (or a different) printer, and then begin supplying toner to a printer. Certain important "machine data" also can be stored in the EPROM memory device on the process cartridge of the present invention. The present invention is also able to declare the "end-of-life" of a process cartridge when the gas-gauge toner sensor is not functional (such as when it has been tampered with).

43 Claims, 12 Drawing Sheets

U.S. PATENT DOCUMENTS

| | | | |
|---|---|---|---|
| 4,647,185 | 3/1987 | Takeda et al. . | |
| 4,666,290 | 5/1987 | Yoshiura . | |
| 4,687,356 | 8/1987 | Matsui et al. . | |
| 4,707,748 | 11/1987 | Ohtsuka et al. . | |
| 4,751,484 | 6/1988 | Matsumoto et al. . | |
| 4,771,313 | 9/1988 | Kuroda et al. . | |
| 4,774,544 | 9/1988 | Tsuchiya et al. . | |
| 4,797,018 | 1/1989 | Hofmann et al. . | |
| 4,803,251 | 2/1989 | Goode et al. . | |
| 4,826,332 | 5/1989 | Ukai et al. . | |
| 4,847,659 | 7/1989 | Resch, III . | |
| 4,851,875 | 7/1989 | Tanimoto . | |
| 4,961,088 | 10/1990 | Gilliland et al. . | |
| 4,963,939 | 10/1990 | Kurando et al. . | |
| 4,974,020 | 11/1990 | Takamatsu et al. . | |
| 5,016,171 | 5/1991 | Connolly et al. . | |
| 5,021,828 | 6/1991 | Yamaguchi et al. . | |
| 5,049,898 | 9/1991 | Arthur et al. . | |
| 5,066,978 | 11/1991 | Watari et al. . | |
| 5,068,806 | 11/1991 | Gatten . | |
| 5,095,331 | 3/1992 | Takano . | |
| 5,101,233 | 3/1992 | Ito et al. . | |
| 5,105,219 | 4/1992 | Yoshikado . | |
| 5,132,729 | 7/1992 | Matsushita et al. . | |
| 5,137,379 | 8/1992 | Ukai et al. . | |
| 5,160,966 | 11/1992 | Shiina et al. . | |
| 5,162,848 | 11/1992 | Saitoh et al. . | |
| 5,184,181 | 2/1993 | Kurando et al. . | |
| 5,204,698 | 4/1993 | LeSueur et al. . | |
| 5,204,699 | 4/1993 | Birnbaum et al. . | |
| 5,216,464 | 6/1993 | Kotani et al. . | |
| 5,235,384 | 8/1993 | Oka et al. . | |
| 5,266,968 | 11/1993 | Stephenson . | |
| 5,272,503 | 12/1993 | LeSueur et al. . | |
| 5,276,461 | 1/1994 | Saito . | |
| 5,283,597 | 2/1994 | Yoshida et al. . | |
| 5,283,613 | 2/1994 | Midgley, Sr. . | |
| 5,289,242 | 2/1994 | Christensen et al. . | |
| 5,318,370 | 6/1994 | Nehowig . | |
| 5,349,377 | 9/1994 | Gilliland et al. . | |
| 5,365,312 | 11/1994 | Hillmann et al. . | |
| 5,452,059 | 9/1995 | Sekiya . | |
| 5,459,556 | 10/1995 | Acquaviva et al. . | |
| 5,489,971 | 2/1996 | Nam . | |
| 5,491,540 | 2/1996 | Hirst . | |
| 5,548,374 | 8/1996 | Iguchi et al. . | |
| 5,572,292 | 11/1996 | Chatani et al. . | |
| 5,579,088 | 11/1996 | Ko . | |
| 5,587,770 | 12/1996 | Jo et al. . | |
| 5,606,403 | 2/1997 | Kikuchi et al. . | |
| 5,610,635 | 3/1997 | Murray et al. . | |
| 5,634,169 | 5/1997 | Barry et al. | 399/27 X |
| 5,636,032 | 6/1997 | Springett . | |
| 5,655,174 | 8/1997 | Hirst . | |
| 5,682,140 | 10/1997 | Christensen et al. . | |
| 5,708,912 | 1/1998 | Lee | 399/24 |
| 5,794,094 | 8/1998 | Boockholdt et al. | 399/27 |
| 5,835,817 | 11/1998 | Bullock et al. . | |

FOREIGN PATENT DOCUMENTS

| | | |
|---|---|---|
| 61-59364 | 3/1986 | Japan . |
| 61-83551 | 4/1986 | Japan . |
| 61-156165 | 7/1986 | Japan . |
| 62-272288 | 11/1987 | Japan . |
| 63-002458 | 1/1988 | Japan . |
| 63-212956 | 9/1988 | Japan . |
| 02072381 | 3/1990 | Japan . |
| 02081056 | 3/1990 | Japan . |
| 03230172 | 10/1991 | Japan . |
| 03289672 | 12/1991 | Japan . |
| 04240661 | 8/1992 | Japan . |
| 04299375 | 10/1992 | Japan . |
| 05040371 | 2/1993 | Japan . |
| 05080607 | 4/1993 | Japan . |
| 05210275 | 8/1993 | Japan . |
| 05210304 | 8/1993 | Japan . |
| 05333626 | 12/1993 | Japan . |
| 06019244 | 1/1994 | Japan . |
| 06035258 | 2/1994 | Japan . |
| 06064789 | 3/1994 | Japan . |
| 06067484 | 3/1994 | Japan . |
| 06075442 | 3/1994 | Japan . |
| 06149051 | 5/1994 | Japan . |
| 06194916 | 7/1994 | Japan . |
| 06230628 | 8/1994 | Japan . |
| 06282139 | 10/1994 | Japan . |
| 07023199 | 1/1995 | Japan . |
| 07028320 | 1/1995 | Japan . |
| 07043964 | 2/1995 | Japan . |
| 07064451 | 3/1995 | Japan . |
| 07104616 | 4/1995 | Japan . |
| 07160157 | 6/1995 | Japan . |
| 07168485 | 7/1995 | Japan . |
| 07175370 | 7/1995 | Japan . |
| 07261634 | 10/1995 | Japan . |
| 07281564 | 10/1995 | Japan . |
| 08069212 | 3/1996 | Japan . |
| 08069213 | 3/1996 | Japan . |
| 08069214 | 3/1996 | Japan . |
| 08146837 | 6/1996 | Japan . |
| 08160680 | 6/1996 | Japan . |
| 08185094 | 7/1996 | Japan . |
| 8-211818 | 8/1996 | Japan . |
| 09022241 | 1/1997 | Japan . |
| 09062152 | 3/1997 | Japan . |
| 09106227 | 4/1997 | Japan . |
| 09114166 | 5/1997 | Japan . |
| 09118038 | 5/1997 | Japan . |
| 09120198 | 5/1997 | Japan . |
| 09120208 | 5/1997 | Japan . |
| 09120235 | 5/1997 | Japan . |
| 09120237 | 5/1997 | Japan . |
| 09120238 | 5/1997 | Japan . |
| 09120241 | 5/1997 | Japan . |
| 09120245 | 5/1997 | Japan . |
| 09120246 | 5/1997 | Japan . |
| 09120247 | 5/1997 | Japan . |
| 09120248 | 5/1997 | Japan . |
| 09120345 | 5/1997 | Japan . |
| 09190121 | 7/1997 | Japan . |
| 9-213407 | 8/1997 | Japan . |

METHOD AND APPARATUS FOR STORING DATA IN A NON-VOLATILE MEMORY CIRCUIT MOUNTED ON A PRINTER'S PROCESS CARTRIDGE

TECHNICAL FIELD

The present invention relates generally to image forming equipment and is particularly directed to printers of the type which have a replaceable process cartridge that includes major components such as a toner supply, developer, and photoconductive drum. The invention is specifically disclosed as a laser printer having a process cartridge that includes a non-volatile memory circuit that contains information about the printer's prior usage, the process cartridge's prior usage, and will prevent the process cartridge from operating with a printer in certain situations.

BACKGROUND OF THE INVENTION

The use of a detachable "process cartridge" on an image forming apparatus such as an electrophotographic (EP) printer is fairly old, having been introduced by Canon in U.S. Pat. No. 4,500,195. This process cartridge included the major components of an EP printer that, during use, become worn or are consumed, such as toner material in a reservoir, a developer unit, a cleaner unit, and a photoconductive (PC) drum.

Another Canon patent, U.S. Pat. No. 4,551,000, discloses a removable "process kit" for an image forming apparatus, in which this process kit contains "consumable members," such as a photoconductive drum, developer unit, cleaner unit, and toner reservoir. The process kit also includes an apparatus "for indicating when the useful life of the process kit is about to expire and when it has expired," which comprises an electronic counter circuit that includes a memory to store the number of operations of the PC drum. The process kit can also contain an LED to act as a warning indicator that the service life has expired, or is about to expire. The counter/memory circuit is provided as part of the process kit. An electrical power source is provided to the counter circuit at all times, whether or not the process kit is attached to the main body of the printer or copier. In this manner, the content of the counter is not erased, but is kept in memory.

The above Canon '000 patent is probably the first patent disclosure to provide a non-volatile memory circuit on a replaceable process cartridge used with a printer or copier. Many other patents or other publications have since added to the list of technical disclosures providing a memory circuit on a replaceable process cartridge, typically to store some type of information, usually in a non-volatile memory device. For example, a method of storing (in a counter variable in a memory device on a process cartridge) the number of prints or copies that have been made is disclosed not only in Canon '000, but also in Japanese patent disclosure document JP 05210304(A), owned by Fujitsu. In JP 05210304(A), the types of information being stored include values of a sheet counter before and after use of the cartridge, number of rotations and time for rotation of a developing roll, and number of rotations and time for rotation of a photosensitive drum.

Another type of information stored in a conventional process cartridge memory device is a cartridge identification number that can be detected by the printer/copier main body when the cartridge is attached. U.S. Pat. No. 5,132,729 (owned by Minolta) discloses an image-forming apparatus having a removable and replaceable having a memory device that stores a recognition number (i.e. a "unit number") of the image-forming unit, and a separate memory unit on board the printer that contains ROM and RAM to test whether or not the unit number is proper with respect to a manufacturer's code. If the process unit is not authentic, the printer or copier can be disabled. Moreover, JP 08069213(A) (owned by Canon) not only stores the serial number, but also stores a counter value, and two different processing conditions. Copying is inhibited if the most significant byte of the serial number is not equal to zero (0) and if the unused areas of addresses 5–63 are not FF (in hexadecimal).

A concept found in some conventional printer/copiers is the ability to limit the service life of a process cartridge based on information being stored in the process cartridge. An example of this is U.S. Pat. No. 5,276,461 (owned by Tokyo Electric) which discloses a laser printer having a replaceable photosensitive cartridge and also having a non-volatile memory mounted to a card base plate. The non-volatile memory comprises an EEPROM integrated circuit, which has a new count value incremented every time the printer produces a new printed sheet of print media. When the photosensitive drum nearly reaches the end of its service life (with regard to the number of copies it has produced), then a message is placed on a display of the printer (and also can be sent to a host computer) to indicate the photosensitive drum must be replaced soon. When the photosensitive drum reaches its maximum number of copies, a new message is displayed saying that the drum has expired, and, in addition, a solenoid ejects the card base plate from its plug-in socket in the microprocessor of the printer, thereby disabling the printer. JP 63212956(A) (owned by Bando Chemical) also determines the remaining service life of a cartridge, primarily based on the remaining quantity of toner, and stores that information in a memory device provided on the cartridge. The remaining quantity of toner or the remaining service life of the photosensitive body are used to calculate the remaining service life of the cartridge, and this information is stored in the memory.

Another concept found in some conventional printer/copiers is the ability to store operating parameters information and to adjust the copier's operating conditions accordingly. This concept is disclosed in U.S. Pat. No. 5,272,503, and also in JP 58132758(A) and JP 08069212(A). U.S. Pat. No. 5,272,503 (owned by Xerox) discloses a printer having an operator replaceable cassette that includes a non-volatile memory device (i.e. an EEPROM). The EEPROM stores a value that varies as a function of the usage of the replaceable cassette. For example, the EEPROM can store the number of prints that have been made using that cassette. This information is later used to adjust certain operating parameters of the printer, including the photoreceptor charge level, exposure level, developer bias level, and the response level of the automatic density control system. The printer also contains a non-volatile memory which is updated by the accumulated print count that is stored in the cassette EEPROM. If the printer determines that an update is due, a new value is written into the cassette's EEPROM memory, where it is retained even if the cassette is later removed from the printer.

JP 58132758(A) (owned by Canon) discloses a process kit used in an image formation device in which a PROM is built on the process unit. Certain information is stored in the PROM, including information to determine exposure, quantity of electrostatic charging, developing bias value, and destaticizing exposure. JP 08069212(A) (owned by Canon) discloses an image forming device that has an exchangeable drum unit, which incorporates a non-volatile memory device. The memory device stores a serial number, counter value, and processing conditions. The processing conditions represent a correction value for the dispersion of the sensitivity of the drum.

Some of the conventional printers/copiers use process cartridges that can have more than one load of toner run through their developer. For example, U.S. Pat. No. 5,548,374 (owned by Toshiba) discloses a printer with two counters which count the total rotations of the photoconductive drum and the total number of toner additions. In one embodiment, the counters are mounted on the printer; in a second embodiment, the counters are mounted in the process unit that contains the toner hopper. A further example is JP 06067484(A) (owned by Ricoh), which discloses an image forming device having a toner supply cartridge that is detachable from a developer unit. The developer unit is provided with an EEPROM, which stores the number of times that toner cartridge attachment is carried out. When the number of times cartridge attachment occurs reaches a reference value, the output of the image forming device is inhibited to prevent an inferior image from being made due to the end of the service life of the developer unit.

Some of the conventional printers/copiers provide process cartridges having memory devices that blow fuses or set memory locations in one direction only (i.e., a "one-way memory" device). For example, U.S. Pat. No. 5,021,828 (owned by Fuji Xerox) discloses a copy machine that includes a "process kit" that has a mechanical counter to count the number of rotations of the photosensitive drum. The process kit also contains at least two fuses, which are blown after a certain number of copies have been made. In the illustrated embodiment, two fuses are included on the process kit, and the first one is blown after 99 sheets have been copied, and the second fuse is blown after 16,000 sheets have been copied. After the second fuse is blown, the consumable items (i.e., toner, etc.) have been expended, and the process kit has come to the end of its life; however, the copier will allow another given number of copies to be made as "grace" copies after the second fuse has blown. The fuses can comprise semiconductors, including diodes or transistors.

Another example of a "one-way memory" device in disclosed in U.S. Pat. No. 5,491,540 (owned by Hewlett-Packard), in which a printer/copier changes a memory location in a memory chip after a certain amount of use. The printer/copier can receive replacement parts, such as a developer cartridge. A memory chip is mounted to the cartridge and is connected to a control computer on the printer side via a single electrical wire. The memory chip can store serial number information for the replacement part, and can also store operational data such as the amount of previous use of the replacement part and how its physical characteristics may have changed over use. The single wire configuration is used so that this new cartridge can replace existing replacement cartridges that use a fuse that can be blown after a certain amount of use.

A further example of a "one-way memory" device in disclosed in U.S. Pat. No. 5,283,613 (owned by Xerox), in which an electrophotographic printer/copier irreversibly sets individual bits in a "flag memory" after a certain multiple of prints have been made by a copy machine. Replaceable cartridges are provided with the copy machine, and the cartridges include a non-volatile memory that is divided into two sections: an electronic "count" memory and an electronic "flag" memory. The count memory maintains a one-by-one count of prints made using the cartridge, while the flag memory sets individual bits upon a certain multiple of prints being made. The count memory can be both read from and written to, however, the flag memory can have its bits alterable from a first state to a second state, but not alterable from the second state back to the first state. The flag memory can be inspected as a tamper-proof check of the actual count value of the pages that have been printed. Once one of the flag bits is set, this lowers the limit of possible allowable remaining count values in the count memory, which in the preferred embodiment uses a counter that counts down from 20,000 to zero copies that are yet available from this cartridge. The type of memory device is disclosed as being a PROM, or an EEPROM which has its charge pump disabled or omitted. Because of this hardware structure, each flag bit can be altered only "downward." The flag bits are set strictly upon a multiple of the prints that have been produced, not upon toner depletion or any other parameter.

Yet another example of a "one-way memory" device in disclosed in U.S. Pat. No. 5,365,312 (owned by Mannesmann AG) which uses a "telephone card" as a memory that can have its contents erased on a bit-by-bit basis. The memory is located on a reservoir, and the memory stores information about the current fill status of the reservoir and the expiration date of the printing medium, relevant for this particular printer. The inventor prefers that the memory on the reservoir be non-volatile, and this memory can be in the form of an integrated circuit, or as a "telephone card" in which a memory strip is contained on the telephone card and can have its contents erased bit-by-bit. In one example, a single memory strip bit is erased for each 10,000 ink droplets printed. Once one of these bit is erased, the bit's modification is irreversible. A timer can also be included that will contain information about the expiration date of the ink fluid. Another read-only memory can be used to store an ID code to identify the ink reservoir. Finally, the counter can be used to activate an alarm when the count value reaches a minimum supply level of the toner.

The conventional image forming printers and copiers could be improved by measuring the actual quantity of remaining toner material in their toner reservoir to enable the image forming apparatus to make more intelligent decisions as to how the apparatus should function with a particular process cartridge. Another improvement would be to store machine operating data in an image forming apparatus, including in a non-volatile memory device mounting on the process cartridge, including data that is stored in an irreversible manner. A further improvement would be to provide alternative means to disable or enable certain functions in an image forming apparatus, including functions that are unrelated to one another.

SUMMARY OF THE INVENTION

Accordingly, it is a primary object of the present invention to provide an image forming apparatus such as a printer that is capable of irreversibly storing information on a memory device that is attached to a process cartridge, in which certain of the information indicates whether or not a particular process cartridge should be allowed to operate with the main body of the apparatus.

It is another object of the present invention to provide an image forming apparatus such as a printer that is capable of measuring the actual quantity of remaining toner material so as to make intelligent decisions about whether or not a particular process cartridge should be allowed to operate with the main body of the apparatus.

It is a further object of the present invention to provide an image forming apparatus such as a printer that is capable of reading from and irreversibly storing information on a memory device that is attached to a process cartridge, in which certain of the information it reads indicates whether or not a particular "escape hatch" is enabled which, in turn, causes one or more disparate functions of the apparatus to operate in one manner or another.

It is yet another object of the present invention to provide an image forming apparatus such as a printer that stores in non-volatile memory "machine data" relating to usage history of the image forming apparatus and/or a process cartridge mounted to the image forming apparatus, and further is capable of irreversibly storing an abbreviated version of such machine data on a memory device that is attached to the process cartridge Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved electrophotographic (EP) printer is provided having a detachable EP "process cartridge" that contains a non-volatile memory device. In addition to the non-volatile memory device, the process cartridge includes certain other major components such as a toner reservoir, a paddle wheel toner level sensor, a developer unit, a "doctor blade" abutting the final developer roller, a "cleaner housing" which includes a cleaner reservoir, a photoconductive (PC) drum, and a cleaner blade.

The non-volatile memory of the preferred embodiment comprises a Dallas Semiconductor EPROM integrated circuit which includes a non-volatile memory that is contained inside a battery case-type housing, which typically has a stainless steel surface. A stainless steel metal plate is provided as an electrical conductor adjacent to the EPROM integrated circuit. When the process cartridge is mounted into a laser printer manufactured by Lexmark International, Inc., the metal plate and the top metal surface of the EPROM integrated circuit mate against corresponding spring-loaded electrical contacts that are permanently mounted inside the laser printer. In this manner, electrical signals can travel between the laser printer and the detachable process cartridge.

In the case of reusable process cartridges, a side opening in the toner reservoir is provided that can be used not only for the initial fill of toner material, but can be used for refills (or "reloads") of the toner material into the toner reservoir of a previously used process cartridge.

The Lexmark laser printer of the preferred embodiment counts the number of toner paddle rotations and also keeps track of the physical toner consumption from the toner reservoir by a method that is disclosed in a commonly-owned U.S. Pat. No. 5,634,169, assigned to Lexmark International, Inc., and which is incorporated herein by reference in its entirety. A "toner wheel" mounted to the exterior of the toner reservoir provides, in conjunction with an optoelectronic sensor, an electrical signal (in the form of pulses) that the printer receives and uses to determine toner usage. A toner "gas-gauge" is created within the printer's operating system which uses "bucket levels" as discrete steps to indicate how much of the physical toner material actually remains within the toner reservoir. This toner "gas gauge" is thereby not dependent upon keeping a cumulative count of pels or pixels that have been printed by the printer's print engine, but instead indicates bucket level changes that are based upon a measured quantity, not a mere accumulated pixel or pel count.

As also disclosed in U.S. Pat. No. 5,634,169, certain information about the toner cartridge can be encoded as a bit pattern on the "toner wheel" which is read by the same optoelectronic sensor used by the "gas-gauge." The Lexmark laser printer of the preferred embodiment herein encodes the non-reusable (or reusable) status of the cartridge on the toner wheel.

In the present invention, after a given amount of toner material has been dispensed through the developer unit, one of the bits of the EPROM memory device is irreversibly burned, thereby providing a permanent record on the process cartridge of a certain amount of toner usage. In this invention, the EPROM memory device acts as a "write once read often" memory device, because the EPROM cannot be erased by ultraviolet light, since the window through which this normally occurs is permanently sealed closed by the manufacturer (i.e., Dallas Semiconductor, Inc. in the preferred embodiment). The burning of a bit in the EPROM memory device occurs at "critical" transitions, which include times when a new bucket level has been reached (i.e., when the amount of toner material remaining in the toner reservoir has decreased to the point where the next lower bucket level is declared to be the "current" bucket level).

As with a normal automobile gas gauge, the toner gas-gauge reading should never increase unless the amount of toner material inside the toner reservoir has increased. There is an exception to this rule, which occurs if the toner material is shaken (by shaking the entire process cartridge), which will have a tendency to create a more uniform level of toner material within the toner reservoir. When that occurs, the movements of the paddle wheel may indicate that additional toner material has apparently been added, whereas in reality the same amount of toner material merely has been more evenly distributed within the toner reservoir. Therefore, the Lexmark printer allows a certain amount of hysteresis (in the form of a bucket level increase) before concluding that toner material has indeed been physically added to the toner reservoir.

The concept of whether or not toner material has been added to the toner reservoir is of critical importance for a non-reusable process cartridge. The user should not attempt to add toner material. Therefore, once the bucket transitions begin to occur for the different gradation levels on the toner gas-gauge, the printer becomes aware that a majority of the toner material has been expended from inside the toner reservoir. If the number of bucket gradation levels increases by more than the hysteresis amount (e.g., by more than six buckets), then the printer will "lock out" the operation of the printer when attempting to use this particular process cartridge. When that occurs, the printer will not operate again until the locked-out non-reusable process cartridge has been replaced.

When the lock-out mode occurs, a particular bit is burned on the EPROM mounted to the cleaner housing of the process cartridge. This ensures that this particular process cartridge cannot be removed, then simply placed back into the same (or a different) printer, and then begin supplying toner to a printer. Since the bit has been permanently burned in the EPROM, whatever laser printer this particular process cartridge is installed into will immediately know that this particular process cartridge has been locked out, and will refuse to operate. For a non-reusable cartridge, a principal objective of the present invention is to limit the life cycle of the cartridge to a single load of toner material, after which the user should re-cycle the cartridge.

The process cartridge can also be locked out if the serial number stored in the EPROM memory device is not equivalent to a valid manufacturer's serial number. This lock-out would occur immediately, before a single print operation was performed by the process cartridge. In addition, bits indicating some of the physical properties of the toner are inspected, including whether the toner is a "high-melt" or a "low-melt" toner material, or whether the toner material is magnetic or non-magnetic.

In addition to the above aspects of the present invention, certain important machine data can be stored in the EPROM memory device on the process cartridge of the present invention. Furthermore, the present invention is also able to declare the end of life of a process cartridge and lock it out when the gas-gauge toner sensor is not functional (such as when it has been tampered with). Under normal circumstances (i.e., when the gas-gauge toner sensor is operational), the toner pixel tally function of the preferred printer continually keeps track of the toner depletion in the process cartridge, although this "toner tally" numeric value is very conservative in that it calculates the amount of toner material consumed at a rate of only about 66% of what is likely to be the actual toner depletion amount. When the toner gas-gauge is operational, as transition gradations (i.e., "bucket levels") are detected the "toner tally" is re-calibrated to indicate the correct amount of toner that is actually remaining within the toner reservoir.

On the other hand, if the toner gas-gauge is not functional, the toner tally continues to accumulate a calculated consumption of toner in grams until it reaches a pre-determined quantity of toner consumed, and when that occurs, if no gas-gauge bucket transitions have been detected for a non-reusable cartridge, the process cartridge is locked out on the basis of the toner tally pixel count.

The machine data research aspect of the present invention also uses the toner tally calculations, and at certain times causes particular information to be written to the EPROM of the process cartridge. For example, after the initial 20 grams of toner material have been consumed, a "cartridge install" event occurs, which marks a committed "marriage" of a process cartridge to a printer main body. The occurrence of the first cartridge installed in a printer further defines the occasion as a "machine install" event. When this occurs, the complete printer serial number is stored in the EPROM of the cartridge, as well as other information, such as the date of printer manufacturer. Certain machine setup information preferably is also stored in the EPROM memory device, such as snapshots of the print engine's operating mode and snapshots of the RIP's operating mode. Furthermore, the error code history of the printer can be stored.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
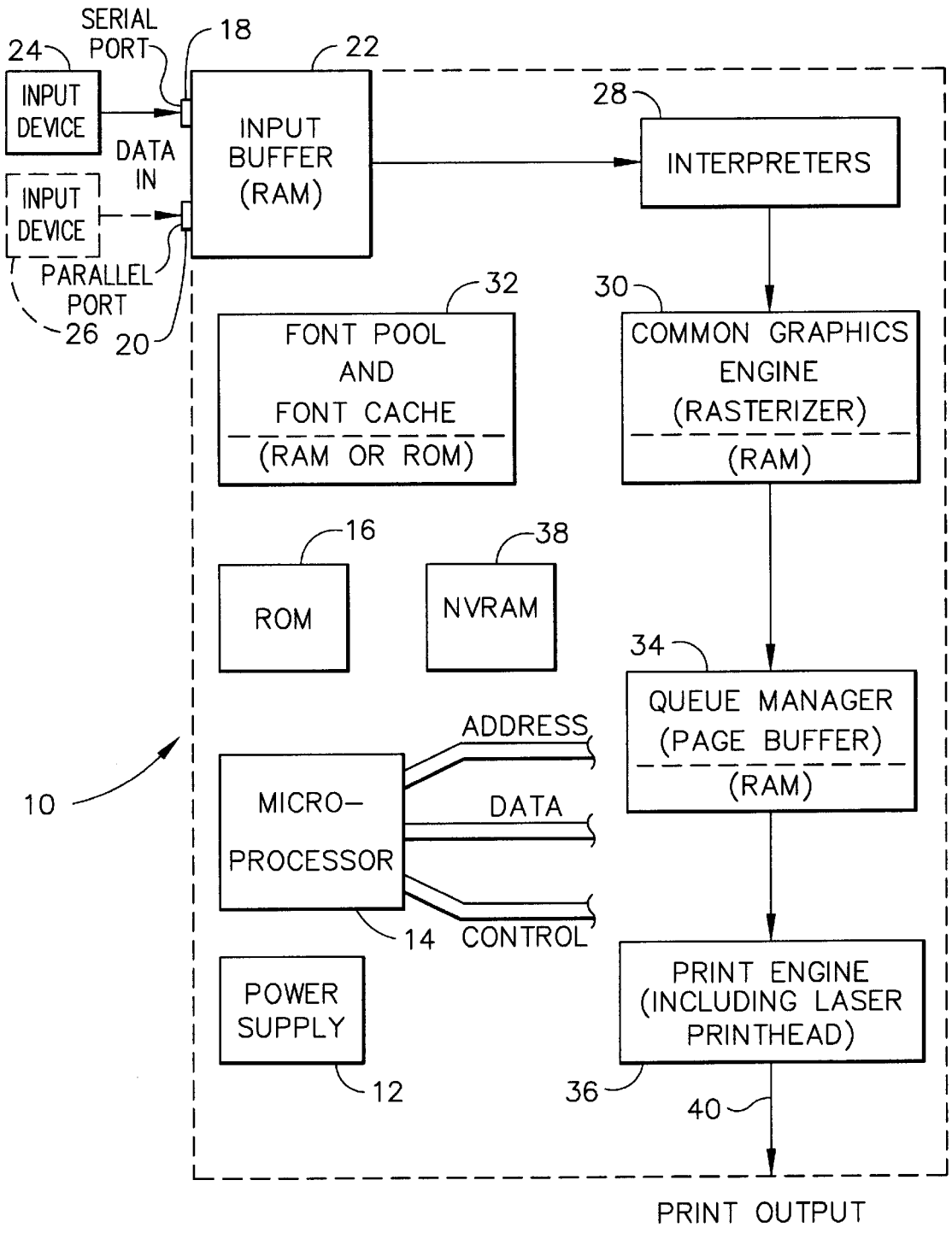
FIG. 1 is a block diagram of the major components of a printer, as constructed according to the principles of the present invention.

Referring now to the drawings, FIG. 1 shows a hardware block diagram of a laser printer generally designated by the reference numeral 10. Laser printer 10 will preferably contain certain relatively standard components, such as a DC power supply 12 which may have multiple outputs of different voltage levels, a microprocessor 14 having address lines, data lines, and control and/or interrupt lines, Read Only Memory (ROM) 16, and Random Access Memory (RAM), which is divided by software operations into several portions for performing several different functions.

Laser printer 10 also contains at least one serial input or parallel input port, or in many cases both types of input ports, as designated by the reference numeral 18 for the serial port and the reference numeral 20 for the parallel port. Each of these ports 18 and 20 would be connected to a corresponding input buffer, generally designated by the reference numeral 22 on FIG. 1. Serial port 18 would typically be connected to a serial output port of a personal computer or a workstation that would contain a software program such as a word processor or a graphics package or computer aided drawing package. Similarly, parallel port 20 could be connected to a parallel output port of the same type of personal computer or workstation containing the same types of programs. Such input devices are designated, respectively, by the reference numerals 24 and 26 on FIG. 1.

Once the text or graphical data has been received by input buffer 22, it is commonly communicated to one or more interpreters designated by the reference numeral 28. A common interpreter is PostScript™, which is an industry standard used by most laser printers. After being interpreted, the input data is typically sent to a common graphics engine to be rasterized, which typically occurs in a portion of RAM designated by the reference numeral 30 on FIG. 1. To speed up the process of rasterization, a font pool and possibly also a font cache is stored, respectively, in ROM or RAM within most laser printers, and these font memories are designated by the reference numeral 32 on FIG. 1. Such font pools and caches supply bitmap patterns for common alphanumeric characters so that the common graphics engine 30 can easily translate each such character into a bitmap using a minimal elapsed time.

Once the data has been rasterized, it is directed into a Queue Manager or page buffer, which is a portion of RAM designated by the reference numeral 34. In a typical laser printer, an entire page of rasterized data is stored in the Queue Manager during the time interval that it takes to physically print the hard copy for that page. The data within the Queue Manager 34 is communicated in real time to a print engine designated by the reference numeral 36. Print engine 36 includes a laser light source within its printhead (not shown), and its output 40 is the physical inking onto a piece of paper, which is the final print output from laser printer 10.

It will be understood that the address, data, and control lines are typically grouped in buses, which are electrically conductive pathways that are physically communicated in parallel (sometimes also multiplexed) around the various electronic components within laser printer 10. For example, the address and data buses are typically sent to all ROM and RAM integrated circuits, and the control lines or interrupt lines are typically directed to all input or output integrated circuits that act as buffers.

Certain critical information concerning the operations of printer 10 are preferably stored in a non-volatile memory device. On FIG. 1, this non-volatile memory device is designated by the reference numeral 38, and is referred to as "NVRAM" (i.e., non-volatile random access memory). However, it will be understood that such non-volatile "RAM" is, in the illustrated embodiment, comprised of an EEPROM integrated circuit. Some of the types of information stored into this NVRAM 38 will be discussed hereinbelow.

Print engine 36 contains an ASIC (Application Specific Integrated Circuit) (not shown), which acts as a controller and data manipulating device for the various hardware components within the print engine. The bitmap print data arriving from Queue Manager 34 is received by this ASIC, and at the proper moments is sent in a serialized format to the laser printhcad.

A removable "process cartridge," generally designated by the reference numeral 100, is provided in printer 10 so that some of the main consumable or wearing components of the printer can be easily replaced in a unitary structure. Process cartridge 100 includes two major sub-assemblies, designated by the reference numerals 110 and 130. Sub-assembly 110 contains the toner reservoir and developer unit, whereas sub-assembly 130 contains the photoconductive (PC) drum and the cleaner reservoir.

Figure 2:
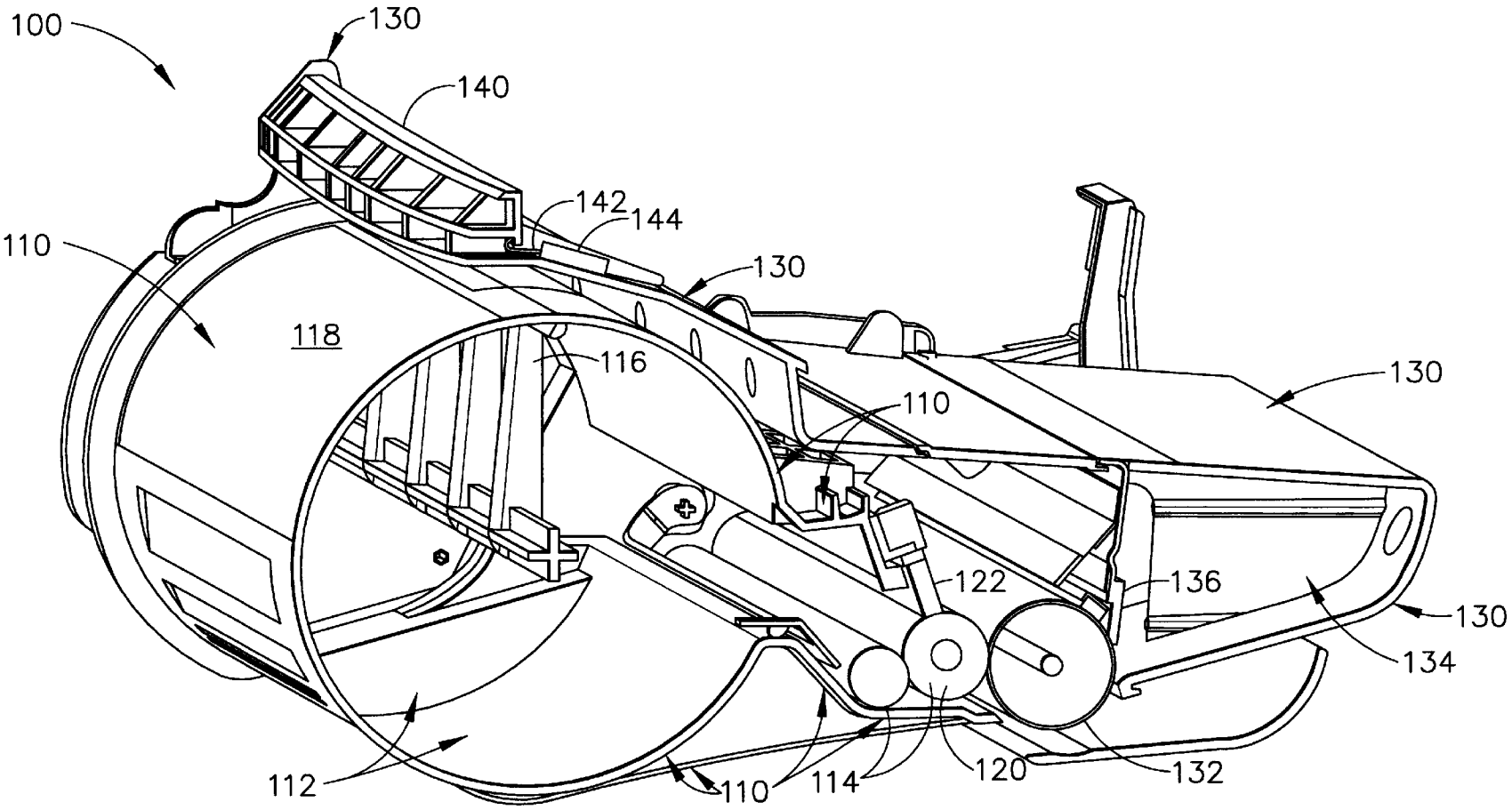
FIG. 2 is a front and side perspective view in partial cut-away of a printer's process cartridge, as constructed according to the principles of the present invention.

The toner/developer sub-assembly 110 depicted on FIG. 2 includes a toner housing 118, toner reservoir 112, and a toner paddle wheel 116. The developer unit 114 includes rollers, including the final developer roller 120, which also is in contact with a doctor blade 122. As is well known to those of ordinary skill in the art, the toner material leaves the reservoir 112 and enters the developer unit 114, where the toner material is evenly spread by the doctor blade 122 across the width of the final developer roller 120. At that point, the toner material is in proper condition to come into contact with the photoconductive drum 132.

The cleaner housing sub-assembly 130 includes a cleaner reservoir 134, a PC drum 132, and a cleaner wiper 136, as major internal components. The cleaner housing sub-assembly 130 extends to the left and above (on FIGS. 2 and 3) the toner/developer sub-assembly 110 such that a portion of the cleaner housing sub-assembly (at the reference numeral 140) will approach an internal portion of the main body of printer 10. As best seen on FIG. 4, this portion 140 that extends to the main body of the printer includes two electrical components that make electrical contact with the circuits of the main printer body. These two components include an EPROM 144 that is contained within a stainless steel casing, and a stainless steel flat plate 142.

EPROM 144 comprises a non-volatile memory device that stores important information relating to printer 10 and process cartridge 100. The top of the stainless steel casing makes electrical contact with a conductor in the printer main body, and the flat plate 142 acts as a return path conductor that mates with another conductor within the printer main body. The information stored in this EPROM 144 is of primary consequence as it relates to the present invention, and will be discuss in great detail hereinbelow.

The physical location of the EPROM memory device 144 was chosen using certain considerations, as follows: the cleaner housing 130 has the extension at 140 that is in mechanical contact with portions of the main printer body, which makes access by the printer 10 to this portion of the cleaner housing relatively simple to achieve. In addition, the forces that are placed on the cleaner housing by virtue of the electrical contact made against the EPROM 144 and the stainless steel plate 142 are transferred into the cleaner housing itself. It is important that these contact forces not be transferred to the interface between the developer unit 114 (i.e., at the final developer roller 120) and the PC drum 132. If the EPROM 144 had been mounted on the toner reservoir housing 118, for example, the additional forces on the toner reservoir would tend to create operational problems for the printer, such as white-gapping, grainy print quality, and compressed print. Therefore, it was deemed much more desirable to have the contact forces press against the cleaner housing sub-assembly 130, which can absorb some torsional loading forces that will not impact the print quality of the interface between the developer unit 114 and the PC drum 132.

Figure 3:
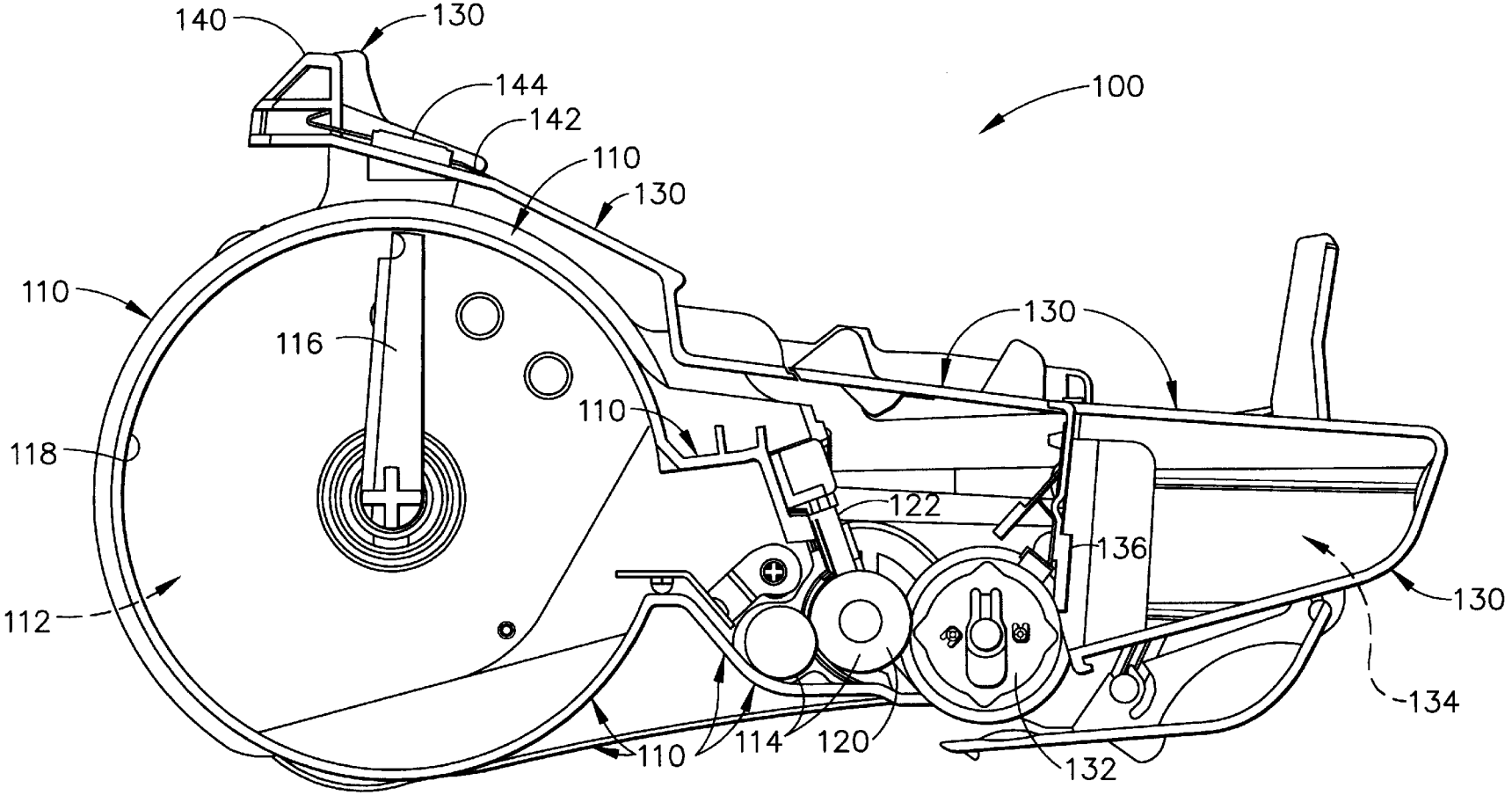
FIG. 3 is a side view in partial cut-away of the process cartridge of FIG. 2.
Figure 4:
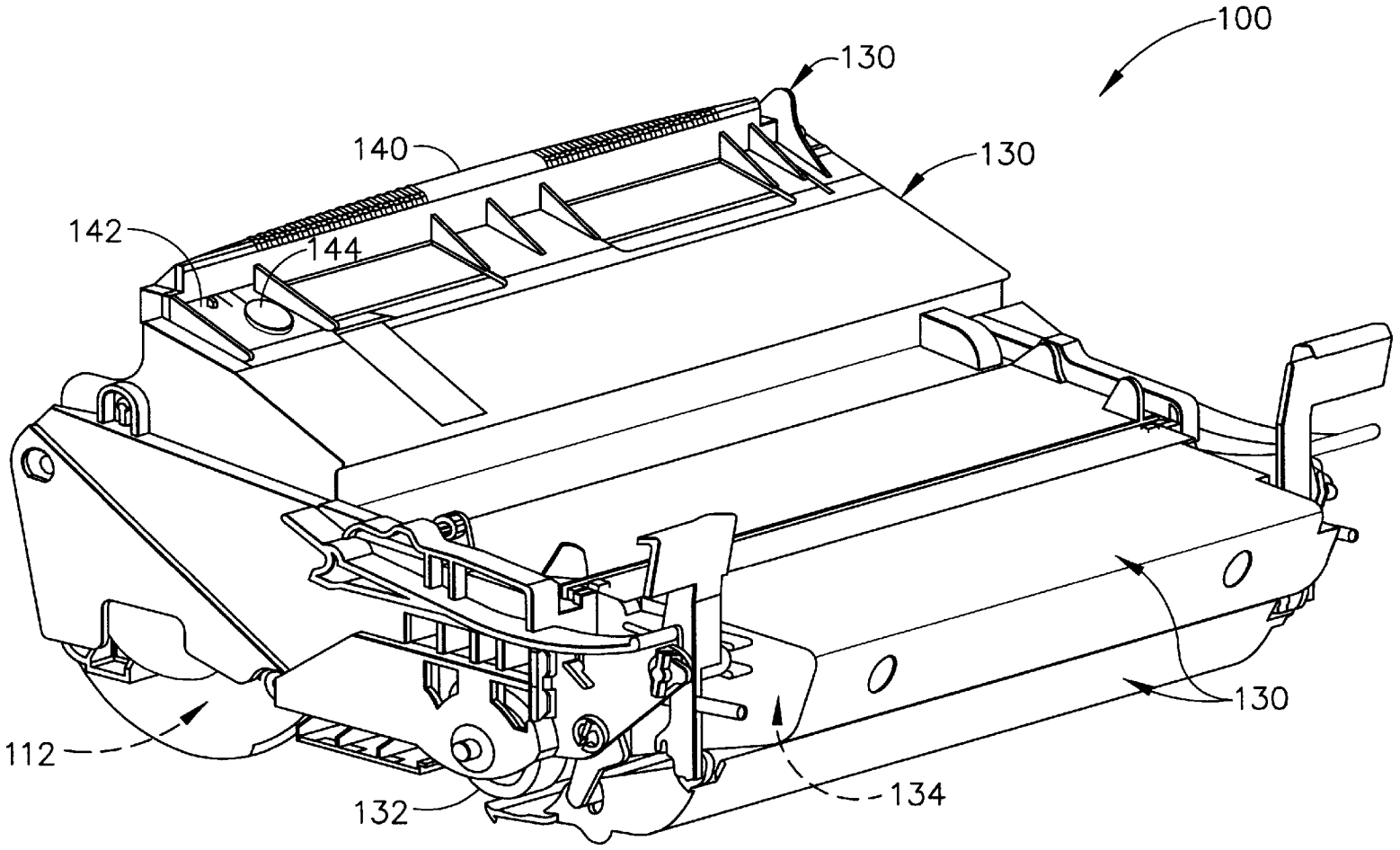
FIG. 4 is a rear and side perspective view of the process cartridge of FIG. 2.

FIG. 3 depicts the same components as in FIG. 2, from a different angle.

Figure 5:
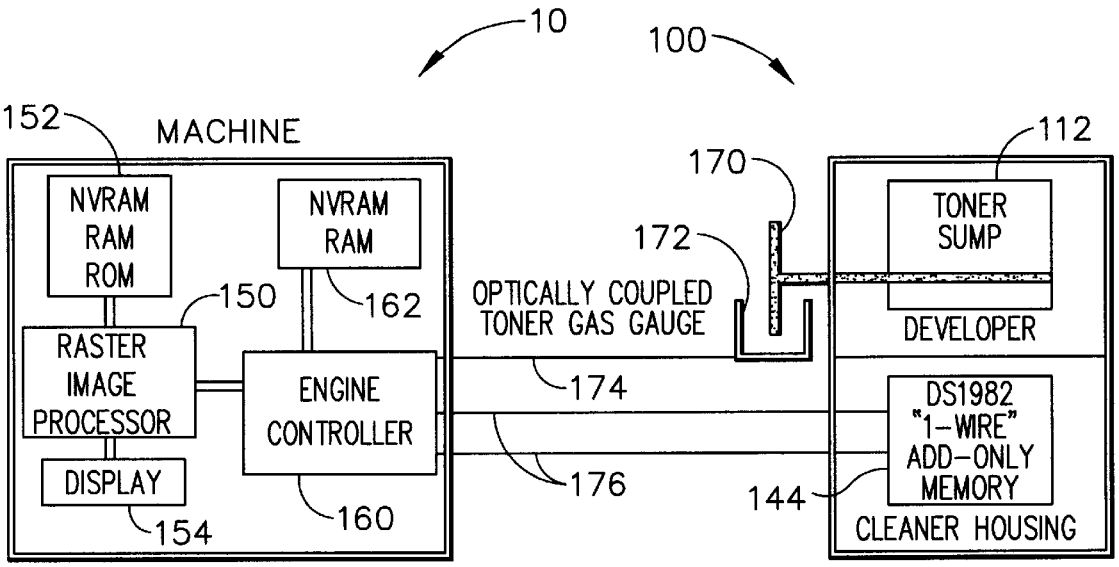
FIG. 5 is a diagrammatic view of a combination of the printer main body of FIG. 1 and the process cartridge of FIG. 2.

FIG. 5 illustrates in block diagram form some of the major components of the printer 10 and how it interfaces with the process cartridge 100. In the printer 10, a raster image processor (RIP) 150 is depicted as being in communication with an "engine controller" 160. The raster image processor 150 includes the microprocessor 14 (see FIG. 1), and also performs certain functions such as the rasterizing function performed (in FIG. 1) by the Common Graphics Engine 30. Raster image processor 150 will also be referred to herein as the "RIP" 150, and it interfaces via electrical buses to memory devices, such as depicted on FIG. 5 by the reference numeral 152. As can be seen on FIG. 5, the memory device 152 includes RAM, ROM, and NVRAM, which roughly correspond to the ROM 16 on FIG. 1, as well as the NVRAM 38 and other random access memory devices depicted on FIG. 1.

The RIP 150 also is communication with a display 154, which preferably comprises a liquid crystal display that can show alphanumeric characters, as are commonly seen on laser printers. The RIP 150, using its programming located in the ROM and data located in its RAM and NVRAM, will control the information depicted on the display 154, and will also control the data flow to and from the engine controller 160.

The engine controller 160 is part of the print engine 36 (see FIG. 1), and is in communication with its own set of RAM and NVRAM, designated by reference numeral 162. It is possible for the NVRAM and RAM memory devices 162 to comprise physical integrated circuits that are also used in part as the NVRAM and RAM 152 used by the RIP 150. However, it is preferred that the portion of RAM in memory device 162 comprise memory registers of an application specific integrated circuit (ASIC) that is used exclusively for the engine controller 160.

Engine controller 160 is also in communication with an optically coupled toner "gas gauge sensor" 172, via an electrical conductor 174. Engine controller 160 is also in communication with the EPROM 144 that is mounted to the cleaner housing sub-assembly 130 of the process cartridge 100. This interface between engine controller 160 and the EPROM 144 is preferably via a two-wire electrically conductive path 176.

On FIG. 5, the toner reservoir 112 is depicted diagrammatically by the terminology "toner sump" and FIG. 5 also diagrammatically shows a "toner wheel" 170 having a shaft that protrudes through the toner sump 112. The operations of toner wheel 170 and its associated optical coupler 172 are described in detail in U.S. Pat. No. 5,634,169 (assigned to Lexmark International, Inc.). In general, the optical coupler 172 outputs an electrical pulse signal along electrical conductor 174 upon every single rotation of the toner wheel 170. The toner wheel 170 turns in conjunction with the paddle wheel 116 (see FIG. 1), which stirs the toner material and tends to drive that toner material into the developer unit 114. When the print engine 36 turns on its transport motor (not shown) to move a sheet of print media through the print engine and past the laser printhead (not shown), the toner wheel 170 rotates.

In addition to counting the pulses that travel along electrical conductor 174, the engine controller 160 and the toner wheel 170 are also designed to determine how much toner material remains within the toner sump (or reservoir) 112. This feature is described in detail in U.S. Pat. No. 5,634,169. By analyzing the information provided by the toner wheel 170, it is possible to create a "gauge" of discrete steps that give a reliable indication as to the actual amount of toner material remaining within the toner reservoir 112 as the toner begins to empty from that reservoir. The gauge of discrete steps of remaining toner material is also referred to herein as a "toner gas gauge," which uses a "gas gauge toner sensor" ("GGTS") that indicates, after a certain amount of the toner material has been dispensed from the toner reservoir 112, the actual amount of remaining toner in the reservoir in discrete steps that are indicative as to the amount of grams of remaining toner material.

This toner "gas gauge" function and its associated apparatus are described in greater detail in two commonly-owned U.S. patents assigned to Lexmark International, Inc., both of which were filed on May 12, 1997, and are now issued as U.S. Pat. No. 5,802,420 and U.S. Pat. No. 5,797,061, both of which are incorporated herein by reference in their entirety. As will be discussed in more detail hereinbelow, the toner wheel indication in discrete steps is also referred to herein as a toner wheel "bucket," which is a rough indication as to the amount of grams of toner material remaining in the reservoir 1 12. As can be seen when viewing FIGS. 12–14, each toner wheel bucket level changes at a pre-determined amount of remaining toner material, and this quantity of remaining toner material is repeatable with a sufficient accuracy across different process cartridges used in a Lexmark laser printer. This repeatability is also maintained for different sizes of such process cartridges.

For example, the "top" bucket level (as seen on FIG. 12) is bucket number 9, and the toner wheel continues to indicate bucket 9 for well over half of the cartridge's initial usage (at least for one of the larger cartridge sizes available from Lexmark International, Inc.). Only when the remaining quantity of toner material falls to approximately 221 grams does the bucket level change from "TWB9" to "TWB8" (i.e., toner wheel bucket level "8"). After that first transition, the bucket level remains at TWB8 while the toner remaining quantity falls to approximately 204 grams, at which time the bucket level makes another transition to "TWB7." These bucket level transitions occur throughout the remaining life of the process cartridge, until reaching the final transition from bucket level "TWB1" to bucket level "TWB0," which occurs at approximately 85 grams of remaining toner material. The use of this bucket level information will be described in greater detail hereinbelow.

The EPROM 144 preferably comprises a Dallas Semiconductor, Inc. integrated circuit, part number DS1982, which is a "one-wire" read only memory device. While most EPROM's are capable of being erased (hence the letter "E" in "EPROM"), the DS1982 integrated circuit is first erased with ultraviolet light at the time of manufacturing, and then its ultraviolet window is permanently sealed so that the chip cannot later be erased after a bit is "burned" or "blown" by a method well known in the art within the EPROM device. Using this construction, the preferred EPROM chip becomes a "one-way" device that can be written to only once, but read many times. Such a chip is also referred to in the industry as an "add-only memory."

Figure 6:
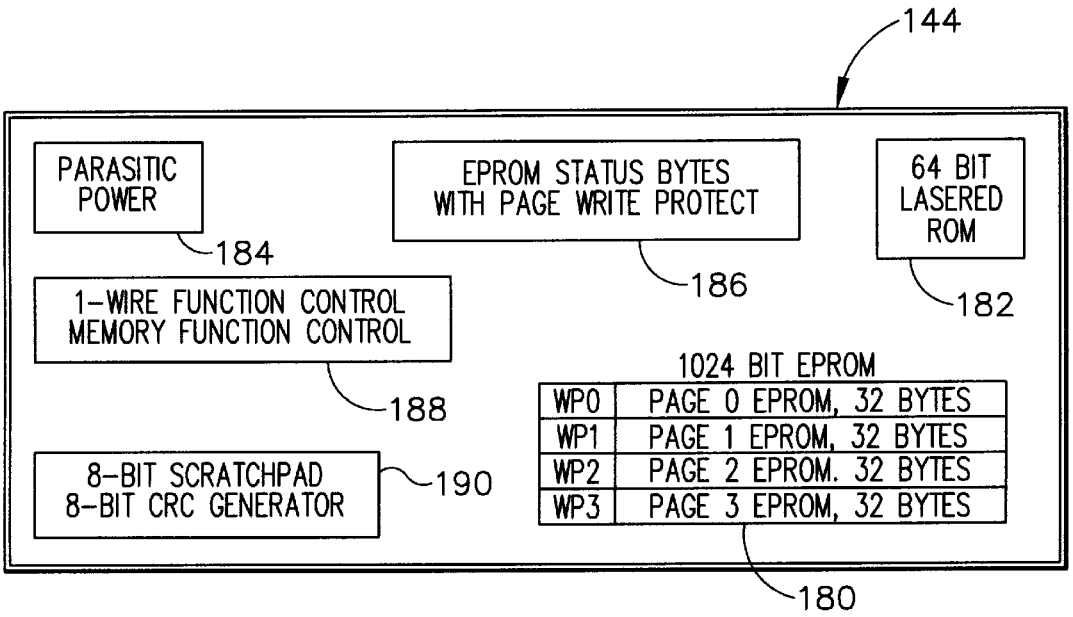
FIG. 6 is a diagrammatic view of the primary components of an EPROM integrated circuit used on the process cartridge of FIG. 2.

FIG. 6 illustrates the major components in block diagram form of the EPROM chip 144. The heart of this EPROM chip comprises 1024 bits of EPROM memory elements, and these bits are logically divided into four individual "pages" of memory elements, each page comprising 32 bytes of eight-bits each. These four pages of EPROM registers are depicted by the reference numeral 180 on FIG. 6, and the individual pages are designated as "WP0," "WP1," "WP2," and "WP3."

EPROM chip 144 also includes an eight-byte "header" area of memory elements, which comprises 64 bits of lasered ROM, as depicted by the reference numeral 182. The information stored in the eight-bit header 182 and the 128 bytes of EPROM memory locations 180 will be discussed in greater detail hereinbelow.

EPROM chip 144 also includes a "parasitic" power supply 184, and a set of registers that indicate the status of the EPROM, and circuitry that can "write protect" each individual page of the EPROM, at 186. EPROM 144 also includes a one-wire function control and a memory function control at 188, and includes an eight-bit scratchpad and an eight-bit CRC (cyclic redundant check) generator, at 190. The details of the construction of the EPROM chip 144 can be obtained from its manufacturer, Dallas Semiconductor, Inc. located in Dallas Tex.

Since EPROM 144 is not only a non-volatile memory device, but also a "one-way" write-only memory device, it can be used to permanently record certain information about the usage of the printer and the process cartridge that cannot be later altered by a user, or anyone else for that matter. This feature is very useful in non-reusable cartridges since the amount of toner that has been consumed by the printer using a particular process cartridge can be determined and stored in the EPROM. If a user or some unauthorized re-manufacturer were to add toner material to the non-reusable cartridge 100, it will become apparent to the printer 10 that the process cartridge has eventually printed more sheets or pels (i.e., print elements) than it should have been capable of printing. Once that has been determined, the printer 10 can "lock-out" this particular process cartridge 100, and refuse to operate any further with that cartridge.

Before that lock-out error state goes into effect, the printer can burn one of the bits in the process cartridge's EPROM 144 that indicates that this process cartridge should not be allowed to operate with any authorized printer. Therefore, if that "locked-out" process cartridge was removed from a first printer that refused to operate with that cartridge, and that cartridge was then installed in a second printer, the second printer would test for that "lock-out bit" and, after determining this process cartridge should not be used, would also refuse to operate with that process cartridge.

The EPROM 144 is also useful to record other types of information, such as various information about consumption and use of the printer by its customers, and this data can also be stored in EPROM 144. For example, the number of new "loads" of toner material added to a particular process cartridge could be stored in EPROM 144. This information can be useful for both non-reusable and reusable cartridges, since a returned non-reusable cartridge can be re-conditioned by an authorized re-manufacturer, and part of that re-conditioning would be to place a new EPROM 144 on the process cartridge. Certain prior usage history regarding this process cartridge could be burned into that EPROM, which could include the number of previous toner loads used in that particular process cartridge. In this manner, the other major components of the process cartridge that have given life cycle expectancies can be monitored to insure that such components do not exceed their life expectancies by being placed into a re-manufactured process cartridge, especially when such components should be instead replaced.

For reusable cartridges, the same life cycle expectancy of major components can be tracked and stored in EPROM 144. If desired, the process cartridge 100 could be prevented from operating with a printer if the number of toner load refills has exceeded a pre-determined number which would cause a performance problem due to the wearing out of one of the major components (such as the PC drum). However, for customer relations reasons, the locking out of a reusable process cartridge may be considered to be inadvisable, even though the large number of toner load refills would indicate that the overall performance of the printer would be compromised by continuing to use a particular process cartridge. Accordingly, it is preferred that a reusable cartridge not be locked out from operating with the printer.

The specific types of information that are placed on EPROM 144 will be discussed next, starting with the eight-bit header information stored in the 64 bit lasered ROM 182. It should be noted that there are two different Dallas Semiconductor integrated circuits that can be used in the preferred mode of the present invention. A part number DS1982U-F3 is known as a "UniqueWare™" device, which is typically more readily available than the second part. The second part has a part number of DS1982-F3, which is a long lead time item because it has a custom identification number etched in its header, i.e., the lasered ROM 182.

In the case of the UniqueWare part, the least eight significant bits represent the part's "family code," and the next most thirty-six bits contain a UniqueWare serial number, which is not used in the preferred embodiment of the present invention. The next most twelve significant bits contain a UniqueWare identification number, and finally the eight most significant bits contain a CRC value.

The laser ROM device (Part No. DS1982-F3) also contains a family code in its least eight significant bits. The next most twenty-four significant bits contain a serial number, which provides 16 million possible serial numbers. The next twelve most significant bits can be user defined, although in combination with the previous twenty-four bit serial number, can provide a capability of 16 times 16 million possible serial numbers by using four of these bits. The next twelve most significant bits are used for a customer identification number, and the final eight most significant bits are also used for a CRC value.

The main portion of memory elements of the EPROM 144 comprise the 1024 bits of non-volatile memory elements 180 that are initially set to a Logic 1 value, and which can be irreversibly cleared to a Logic 0 on a bit-by-bit basis. As discussed above, these 1024 bits are logically divided into four 32-bit "pages." Each of the logical pages of this set of EPROM memory elements 180 can be physically write-protected by circuitry that falls within the function block 186 as depicted on FIG. 6. Once a page has been write-protected, none of its bits can then be burned thereafter, and their values at that point are permanently set as either Logic 1 or Logic 0.

The preferred definitions of the bytes and bits for the EPROM memory elements 180 is presented below, in Table #1:

TABLE 1

| 4–256 bit quadrants of programmable memory | | |
|---|---|---|
| Page 0 | 0–255: | Uniqueware: Lexmark ID 1+4+2=7 bytes; 3 byte S/N+21 bytes for ASCII Text.<br>Laser ROM: reserved and unused at this time. |
| Page 1 | 256–511 | Configuration information; write protected after factory configuration. |
| Page 2 | 512–767 | Data fields tracking cartridge through 1 life, lockout byte, EC level, machine data |

TABLE 1-continued

Page 3 768–1023 Machine Research data.
Page Layout

Page 0
A. DS1982U-F3 Uniqueware: 4 Byte Length/CRC/; 4 Byte Lexmark ID; 3 byte S/N; & 21 bytes for ASCII Text.
B. DS1982-F3 ROM Version - Page 0 reserved and unused at this time Page 1, Configuration, 32 bytes. Write protected after factory programming.

| Byte | Bit | Description |
|---|---|---|
| 0 | all | OEM ID |
| 1 | 7 | Remanufact. |
| | 6 | Non-reusable |
| | 5 | PC type |
| | 4,3 | Toner |
| | 2,1,0 | Capacity |
| 2 | 7,6 | Laser Pwr |
| | 5,4 | Transfer V |
| | 3,2 | Developer V |
| | 1,0 | Charge Roll |
| 3,4 | all | Last 4 digits of cartridge Part Number |
| 5 | all | Actual toner load in 4 gram increments |
| 6 | 7 | Config/OEM escape hatch |
| | 6 | Project ID escape hatch |
| | 5 | Non-reusable refill escape hatch |
| | 4 | Non-reusable 100 g in bucket 0 escape hatch |
| | 3 | Non-reusable 190 g left/bucket 9 escape hatch |
| | 2 | Machine data escape hatch |
| | 0–1 | reserved |
| 7 | all | Reserved |
| 8 | all | Current Developer build level in BCD |
| 9 | all | Current Cleaner Housing build level in BCD |
| 10 | all | Current Final Assembly build level in BCD |
| 11 | all | Prior Developer build level in BCD |
| 12 | all | Prior Cleaner Housing build level in BCD |
| 13 | all | Prior Final Assembly build level in BCD |
| 14 | all | Cleaner cycles |
| 15 | all | Cleaner blade cycles |
| 16 | all | Cleaner seal cycles |
| 17 | all | Developer housing cycles |
| 18 | all | Developer roll cycles |
| 19 | all | Doctor blade cycles |
| 20 | all | TAR cycles |
| 21 | all | Developer seal cycles |
| 22 | all | PC cycles - total |
| 23 | all | PC cycles since last refurbished |
| 24 | all | Dev roll production month |
| 25 | 7,6,5 | Number of developer uses |
| | 4,3,2 | Number of cleaner housing uses |
| | 1,0 | Number of drum refurbishings |
| 26–30 | all | 5 byte BCD Cartridge S/N |
| 31 | all | Checksum |

Page 2, Cartridge lifetime tracking and machine data.

| Byte | Bits | Description |
|---|---|---|
| 0 | 7 | Detected 6 Bucket Refill on non-reusable cartridge |
| | 6 | No 9—>8 transition and 190 g of toner used |
| | 5 | Used more than 100 g of toner after seeing |
| | 1–4 | Reserved |
| | 0 | Lockout- |
| 1 | 7 | Bucket 9 |
| | 6 | Bucket 8 |
| | 5 | Bucket 7 |
| | 4 | Bucket 6 |
| | 3 | Bucket 5 |
| | 2 | Bucket 4 |
| | 1 | Bucket 3 |
| | 0 | Bucket 2 |
| 2 | 7 | Bucket 1 |
| | 6 | Bucket 0 |
| | 5 | Cycles Valid- |
| | 0–4 | Reserved |
| 3 | All | Cycles at toner low high byte |

TABLE 1-continued

| | | |
|---|---|---|
| 4 | All | Cycles at toner low low byte |
| 5 | All | Chip EC level |
| 6 | All | Reserved |
| 7 | All | Reserved |
| 8 | All | Error log byte 1 |
| 9 | All | Error log byte 2 |
| 10 | All | Error log byte 3 |
| 11 | All | Error log byte 4 |
| 12 | All | Error log byte 5 |
| 13 | All | Error log byte 6 |
| 14 | All | Error log byte 7 |
| 15 | All | Error log byte 8 |
| 16 | All | Error log byte 9 |
| 17 | All | Error log byte 10 |
| 18 | All | Error log byte 11 |
| 19 | All | Error log byte 12 |
| 20–31 | All | Reserved for future expansion |

Page 3, Machine research data.

| Byte | Bits | Description |
|---|---|---|
| 0–7 | All | Complete Machine Serial Number as displayed on Test Page |
| 8–9 | All | Machine date of manufacture |
| 10–13 | All | Permanent page count |
| 14–21 | All | Number of cartridges installed in printer by capacity. |
| 22 | All | Reserved |
| 23 | All | PCI Slot Description 1 |
| 24 | All | PCI Slot Description 2 |
| 25 | All | Display language |
| 26–29 | All | Cycle count |
| 30 | 4–7 | Darkness |
| | 0–3 | Resolution |
| 31 | 7 | PQET on/off |
| | 6 | IET on/off |
| | 5 | IET mode |
| | 4 | Duplex mode |
| | 0–3 | Reserved |

As can be seen by a close inspection of Table #1, much of the information stored in EPROM 144 relates to "machine data" that concerns particular usage patterns of a process cartridge. In situations where the end user objects to having certain types of the information normally stored in the EPROM 144, there are "escape hatches" that can be activated by the user or selected by the manufacturer to prevent selected types of information from being stored on EPROM 144. These escape hatches will be explained below, during the discussion of the flow charts that explain the functionality of the important features of the invention.

With regard to "locking" (i.e., write-protecting) some of the information on EPROM 144, Page 1 preferably is locked at the time of manufacturing, either by Lexmark International, Inc., or by one of its authorized manufacturers of process cartridges. In the preferred mode of the present invention, Pages 2 and 3 are never locked. If the EPROM 144 is a UniqueWare part, then Page 0 is locked by Dallas Semiconductor, Inc. If the EPROM 144 is a laser ROM part (rather than a UniqueWare part), Page 0 is not locked.

Figure 7:
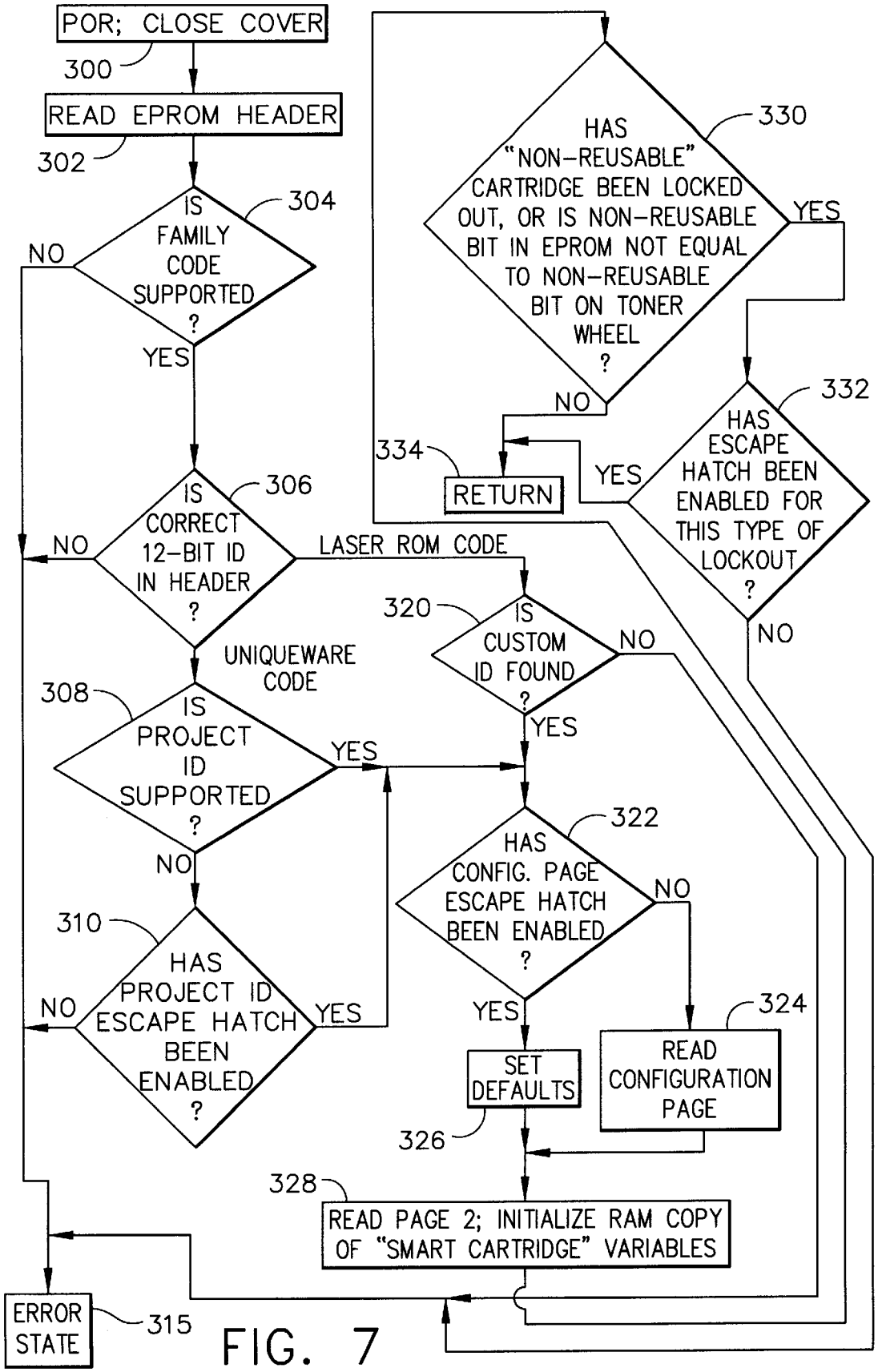
FIG. 7 is a flow chart of the initialization subroutine of the printer of FIG. 1.

The flow chart depicted on FIG. 7 performs functions that occur immediately after the printer's cover is closed, or after a "power on reset" occurs, starting at a step 300. The microprocessor in the printer main body 10 now reads the EPROM 114 header information at a step 302. This is the header information that is contained in the 64 byte lasered ROM 182. After reading that header, a decision step 304 determines whether or not the family device code is supported. If the EPROM is a UniqueWare part, its family code is 89 (in hexadecimal). If the EPROM 114 is a laser ROM part, its family code is 09 (in hexadecimal). As long as one of these two family codes is found in the header information, the result at decision step 304 will be YES. If the answer is NO, then the logic flow is directed to an error state step 315, and the microprocessor in the printer main body 10 will not operate with this particular process cartridge 100.

If one of the two family codes that are supported was found, a decision step 306 is now implemented, which looks to see if the correct 12-bit identification number is found in the header information. This header is found in the most significant twelve bits of the header information that abut the CRC, which itself comprises the most significant eight bits of the entire header. If the result of this inspection reveals a laser ROM code, the logic flow is directed to a step 320. If the result of this inspection reveals a UniqueWare code, then the logic flow is directed to a step 308. If neither correct code is found in the header, then the logic flow travels out the NO result, which directs the logic flow to the error state step 315.

If the EPROM 144 is a UniqueWare device, then the next step 308 is a decision step that inspects the project identification number to see if it is supported. In the preferred embodiment, this project identifier is not found in the 64 bit header, but instead is found in Page 0, in bytes 1–5 of the EPROM memory elements 180, as can be seen in Table #1. This code (if correct) represents a Lexmark proper EPROM for use in the process cartridge and printer combination. If the result of this inspection is YES, then the logic flow is directed to a step 322. If the result of this inspection is NO, then a decision step 310 determines if the project identification number "escape hatch" has been enabled. If the answer to this question is YES, then the printer will continue to operate past this step and the logic flow is directed to step 322. If the escape hatch has not been enabled, then the logic flow travels out the NO result of decision step 310, and the logic flow is directed to the error state 315.

If the header information indicates that EPROM 144 is a laser ROM, then step 320 determines whether or not the correct custom identification number is found in the header. If the answer is YES, then the logic flow is directed to the step 322 and the printer and process cartridge combination continues to operate. If the answer is NO, then the logic flow is directed to the error state 315.

Once the logic flow has reached the decision step 322, it is determined whether or not the configuration page escape hatch has been enabled. If the answer is NO, then a step 324 reads the "configuration page," which is comprised of bytes 0–6 on Page 1 of EPROM 144. This "configuration page" primarily consists of initialization information, such as the identification of the original equipment manufacturer, whether or not the cartridge is a non-reusable cartridge, the type of toner material, the type of photoconductive drum, the capacity in grams of the toner reservoir of the process cartridge, the logic state of the escape hatch decisions, and other various information that can be found in Table #1.

On the other hand, if the configuration page escape hatch was enabled, then the logic flow travels out the YES output of decision step 322, and defaults are set at a step 326. In this situation, the configuration page information is not read by the printer 10. The values of the defaults will allow this combination of printer and process cartridge to continue to operate past this step. In the preferred embodiment, the default values for some of the "configuration page" information includes the following: OEM ID=Lexmark; Not a Lexmark remanufactured cartridge; Reusable cartridge; PC drum type=Trailridge; Toner type=low melt; Capacity=23K pages; Laser power=standard; Transfer voltage=standard; Developer voltage=standard; Charge roll voltage=standard; and Toner load=600 grams.

After either the configuration page is read or the defaults are set, the logic flow is directed to a step 328 that reads Page 2 of the EPROM memory elements 180. This information is placed in bytes 0–2 of Page 2 of the EPROM, and contains information such as the last bucket level seen by the toner wheel of this process cartridge. It also contains other information pertaining to error conditions that could lead to a lock-out condition for a non-reusable cartridge. This information is uploaded from the EPROM 144 and placed into RAM of printer 10, and this RAM copy of the "smart cartridge" variables is then initialized.

The logic flow is now directed to a decision step 330 that determines if a non-reusable cartridge should be accepted. This first inspects bit 0 of byte 0 of Page 2 of EPROM 144, and if bit 0 is blown, then this process cartridge should be locked out. As can be seen in Table #1, bits 5–7 of byte 0, Page 2 give the reason for the lockout. Next, bit 6 of byte 1 of Page 1 of EPROM 144 is compared to the "non-reusable bit" received from the toner wheel. If these bits do not match, then this process cartridge should be locked out. If the cartridge has not been locked out and the two non-reusable bits match, then the logic flow travels out the NO result and is directed to a "return" step 334, at which time this subroutine of FIG. 7 has completed its task.

If decision step 330 results in a YES answer, the logic flow is directed to a decision step 332 that determines whether or not the escape hatch has been enabled for a non-reusable cartridge lock-out. If the answer is NO, then the logic flow is directed to the error state step 315, and the printer will not operate with this process cartridge 100. If the answer is YES, then the logic flow is directed to the return step 334, and the printer will continue to function with this process cartridge, even though a condition exists that would normally prevent this cartridge from being used by the printer.

Figure 8:
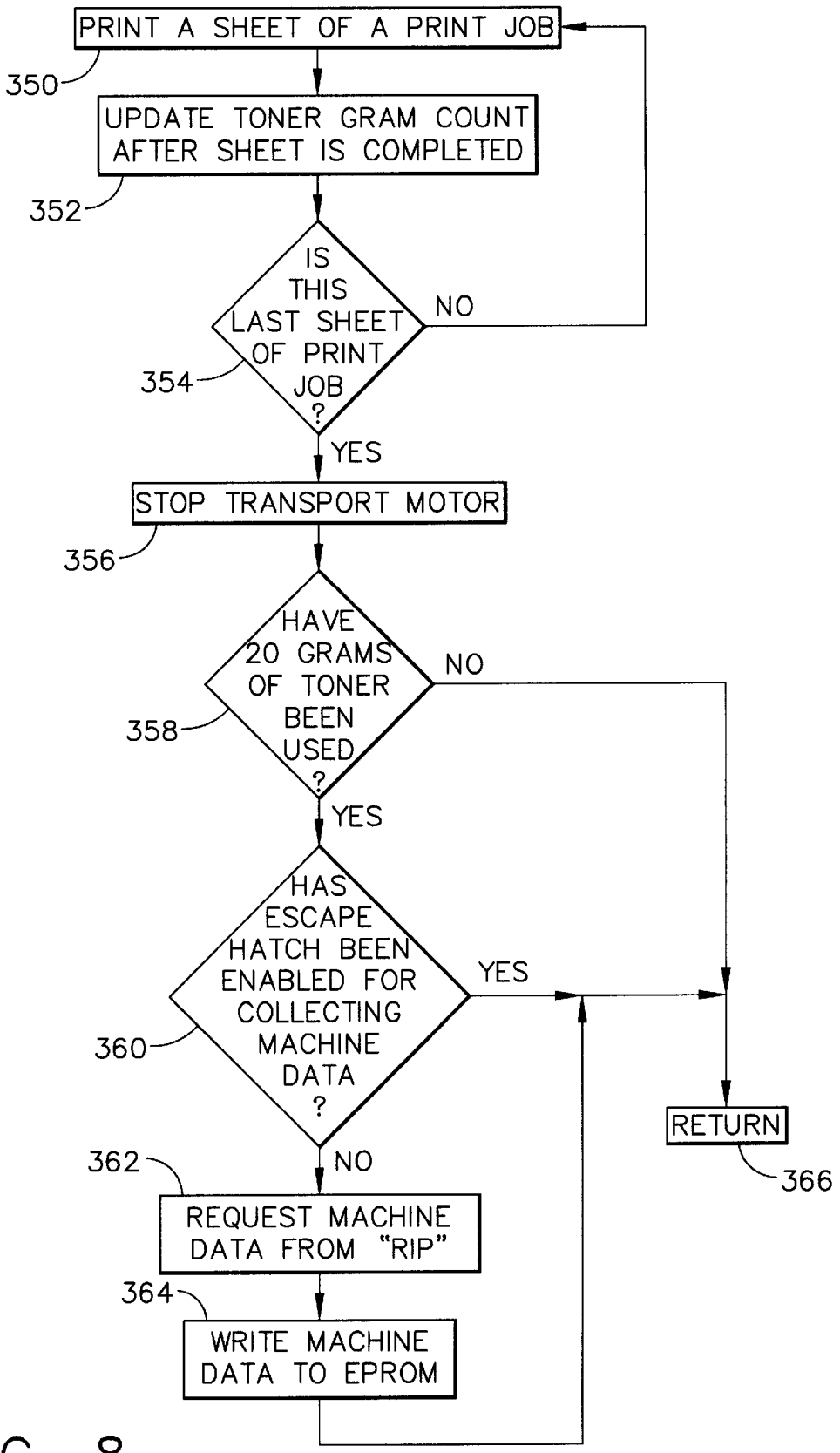
FIG. 8 is a flow chart of the subroutine that initiates storing of machine data on the process cartridge of FIG. 2.

On FIG. 8, a flow chart is provided that describes the method steps performed by the printer 10 that will initiate the gathering of "machine data." This machine data is stored in various places in both the printer 10 and the process cartridge 100. For example, the EPROM 144 allocates some of its memory locations in its EPROM registers 180 exclusively for machine data. As can be seen in Table #1, all of Page 3 (i.e., WP3) and part of Page 2 (i.e., WP2) are reserved for storing machine data.

There is also "machine data" stored in non-volatile memory of the printer 10, and it is this information that is uploaded into the EPROM 144 after the process cartridge is "married" to a particular printer. This does not occur immediately upon installation of the process cartridge into the printer, but instead in the preferred embodiment this "marriage" of process cartridge to printer does not occur until after 20 grams of toner material has been consumed.

Starting at a step 350 on FIG. 8, a sheet of print media is printed for a particular print job. This step is arrived at for every print job received by printer 10. After that occurs, at a step 352 the toner gram count is updated after this sheet of print media has completed its printing. This toner gram count is determined by a "toner tally" which is an estimate of the quantity of toner material that has been consumed from the process cartridge 100 after it has been installed in printer 10. The toner tally estimate is based strictly upon the number of pels that have been printed, and is not based upon the "gas gauge sensor" 174 that produces electrical signals from the toner wheel's rotations. At this point in the life of the process cartridge 100, the preferred gas gauge sensor-toner wheel apparatus is not capable of producing a reliable indication of a mere 20 grams having been consumed. As related above, the preferred toner wheel-gas gauge sensor combination is not designed to produce changes in the gas gauge "bucket" level until a much larger quantity of toner material has been consumed.

After step 352, a decision step 354 determines whether or not the sheet of print media that was just completed was also the last sheet for a particular print job. If the answer is NO, the logic flow is directed back to step 350. If the answer is YES, then the logic flow is directed to a step 356, at which time the transport motor (not shown) is halted.

A decision step 358 is now reached in the logic flow, and this step determines whether or not at least 20 grams of toner material has been consumed. As noted above, this determination is based upon a toner tally, which is a relatively conservative estimate of toner usage based upon the number of pels that have been printed using the current process cartridge 100 in this printer 10. The use of the term "conservative" is appropriate, since the toner tally is purposefully scaled by a factor of two-thirds, which means that, in all likelihood, a total of 30 grams of actual toner material has been consumed, even though decision step 352 only considers the amount of toner consumed to have been 20 grams. This conservative estimate of the toner tally will also be used in other decisions made by printer 10, as will be explained hereinbelow.

If the answer is NO at decision step 358, then the logic flow is directed to a return step 366, which ends this subroutine. If the answer is YES, then the logic flow is directed to a decision step 360.

At step 360, it is determined whether or not the "escape hatch" has been enabled for collecting machine data. If the answer is YES, then the logic flow is directed to the return step 366, and "machine data" is not used or reported when using this process cartridge 100. If the answer is NO, then the logic flow is directed to a step 362 which requests that machine data be uploaded from the RIP 150 of printer 10.

Once the machine data is uploaded from the printer 10, this same machine data is then written into EPROM 144 of the process cartridge 100 at a step 364. After the machine data has been burned into EPROM 144, the logic flow is directed to the return step 366. As discussed above, this burning of bytes into EPROM 144 is a permanent record that cannot be altered by erasing the EPROM with ultraviolet light. That will be quite impossible, since the window of the EPROM chip through which ultraviolet light would normally enter is permanently sealed closed by the manufacturer, Dallas Semiconductor, Inc.

As related above, all 32 bytes of Page 3 of EPROM 144 are reserved for machine data, which means that all of these bytes (as appropriate) are burned to produce a permanent record for their information types. Other portions of the machine data are burned into bytes 8–19 on Page 2 of EPROM 144, which similarly provides a permanent record for the appropriate types of data.

As related above, the machine information is uploaded from the RIP 150 of printer 10. It should be noted that in the preferred embodiment, not all of this information comes from an NVRAM device on printer 10. Certain information is available in real time from elsewhere within printer 10. For example, the description of the PCI slot is made available from the PCI interface circuitry of printer 10, and this information is stored in bytes 23–24 of Page 3 of EPROM 144. Furthennore, the information that is stored in bytes 30–31 of Page 3 of EPROM 144 is made available from the print engine 36 of printer 10, and this is information that is not directly stored in one of the NVRAM devices of printer 10.

A final note concerning the downloading of machine information into EPROM 144 is that, when bytes are burned into the EPROM registers 180, these tasks become non-interruptable by the processors involved. In the preferred mode of the present invention, it is considered more important to properly burn the bytes of these EPROM registers than to accept interrupts from other portions of printer 10's operations, including an interrupt that might be received due to a new piece of data arriving at an input port. Printer 10 will preferably be designed such that its receive buffers are sufficiently capable of handling new data for a sufficiently long enough period of time so that there will be no overflow of data and no major delay in handling new data packets caused by the burning of these EPROM bytes.

Figure 9:
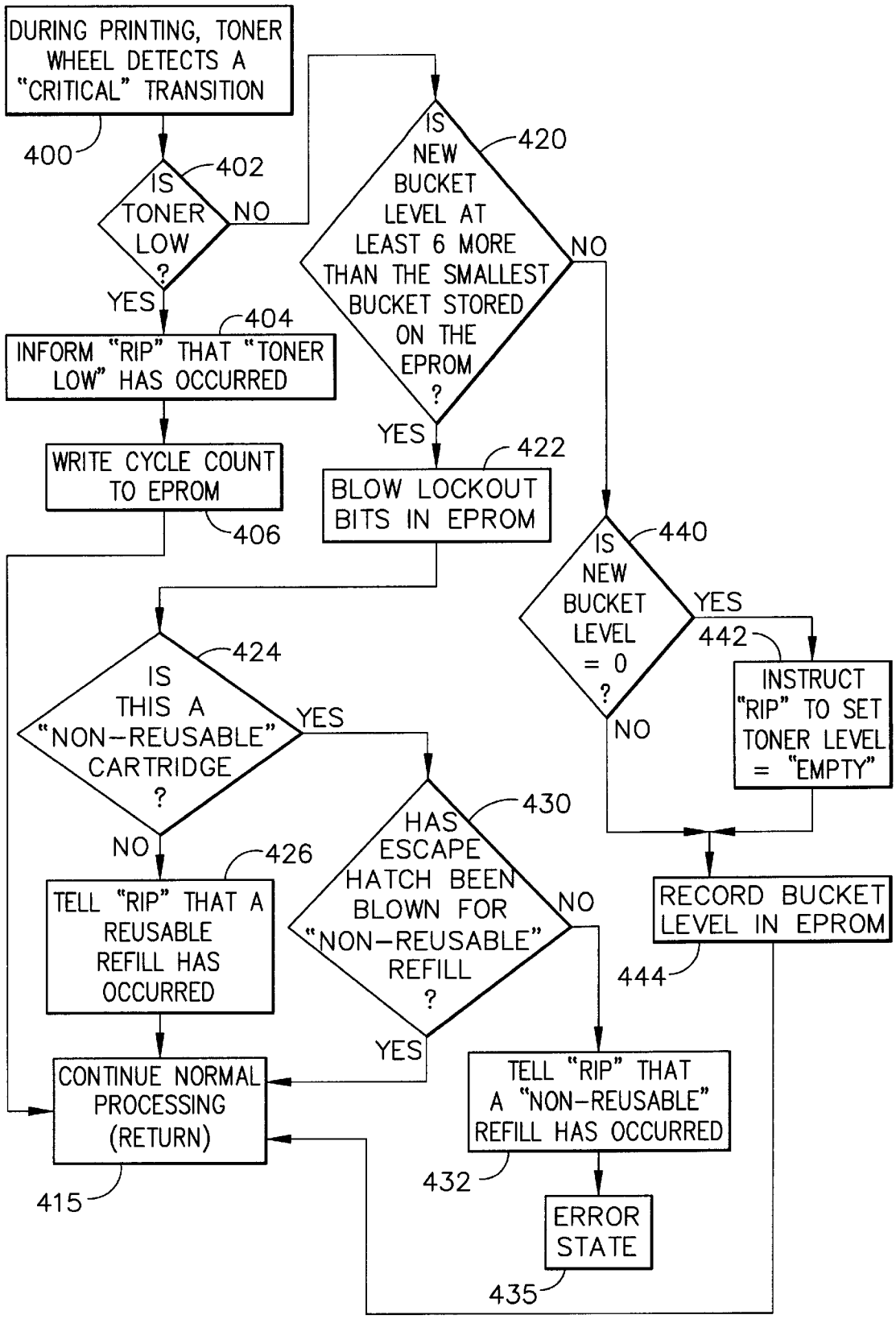
FIG. 9 is a flow chart of the subroutine that determines if the process cartridge of FIG. 2 has experienced a toner refill after some of the toner has been consumed.

FIG. 9 is a flow chart concerning certain events involving the toner wheel 170. It should be noted that the preferred embodiment of toner wheel 170 involves measuring the amount of torque required to rotate the paddle wheel 116 through the toner reservoir 112. The larger the quantity of remaining toner material within reservoir 112, the more torque required to rotate the toner paddle 116, and thus the longer it will take the toner wheel 170 to sweep through the toner in reservoir 112. In the preferred embodiment, the torque values received from toner wheel 170 are constantly being averaged from one rotation to the next, to better determine the precise number of grams of toner material remaining within reservoir 112.

Referring to FIG. 9, during printing, a step 400 determines if the toner wheel has detected a "critical" transition. A "critical" transition in the preferred embodiment occurs when one of the several points is reached where the bucket level changes, or when the toner becomes "low" inside the process cartridge 100. All of these transitions are determined by the gas gauge sensor 172 measuring the rotation of toner wheel 170, and the amount of torque that is required to provide that rotation through the toner reservoir 112. In the preferred embodiment, these bucket level transitions occur at the following quantities of toner material remaining:

TABLE 2

| BUCKET LEVEL | GRAMS OF TONER REMAINING |
|---|---|
| 9 | Capacity (about 600 g) through 222 g |
| 8 | 221–205 g |
| 7 | 204–188 g |
| 6 | 187–171 g |
| 5 | 170–154 g |
| 4 | 153–137 g |
| 3 | 136–120 g |
| 2 | 119–103 g |
| 1 | 102–86 g |
| 0 | 85–0 g |

As can be seen from Table #2, there are nine bucket transitions and the toner "low" transition in the preferred embodiment that make up the definition of "critical" transitions according to step 400 on FIG. 9. The logic flow now is directed to a decision step 402 that determines if the toner is "low," which occurs if there are only 100 grams of toner remaining within reservoir 112. If the answer is YES, the logic flow is directed to a step 404. If the answer is NO, the logic flow is directed to a decision step 420.

At step 404, the RIP 150 is informed that a "toner low" transition has occurred. After the RIP 150 has been informed of the "toner low" condition, the operator panel display 150 will indicate a message that the toner is now low. A step 406 now writes the toner wheel cycle count to EPROM 144. This cycle count is stored in EPROM 144 in its EPROM registers 180 at Page 2, bytes 3–4. After that occurs, the logic flow is directed to a step 415, which continues the printer's normal processing (and acts as a "return" from this subroutine).

If the answer was NO at decision step 402, that means that the "critical" transition was a bucket level change. A step 420 now determines if the new bucket level is at least six levels greater than the smallest bucket level that had been stored on EPROM 112. If the answer is YES, that provides an indication that the toner reservoir 112 has been refilled with new toner material, and a step 422 will burn the "lock-out bits" in EPROM 112. The appropriate "lock-out bits" are found in the EPROM memory registers 180 on Page 2, at byte 0, bits 0 and 7 in the preferred embodiment.

A decision step 424 now determines whether or not the process cartridge 100 is a non-reusable cartridge. The EPROM registers 180 store a bit that indicates whether or not the cartridge is a non-reusable cartridge. This is bit 6 of byte 1 of Page 1. If the answer is NO, then a step 426 tells RIP 150 that a "reusable cartridge" refill has occurred, and the printer will continue normal processing at step 415. If the answer is YES at step 424, then a decision step 430 determines whether or not the escape hatch bit has been blown for a "non-reusable refill." If the answer is YES, then normal processing is continued at step 415.

If the answer is NO at step 430, then a step 432 informs RIP 150 that a non-reusable refill has occurred. When that happens, the printer 10 has determined that a non-reusable cartridge has been refilled, and a step 435 will declare an "error" state. When this error state is reached, printer 10 will refuse to operate with this particular process cartridge 100 and that cartridge becomes "locked-out" from operating.

If the result at step 420 was NO, then a decision step 440 determines if the new bucket level is equal to zero (0). If the answer is NO, then a step 444 records the new bucket level in the EPROM registers 180 on Page 2, in bytes 1 or 2, as appropriate. Normal processing is then continued at step 415.

If the answer was YES at 440, then that means there are only 86 grams of toner material remaining within reservoir 112. In that situation, a step 442 instructs RIP 150 to set the toner level to "Empty," which is a message that shows up on the printer MENU test page. After that occurs, the new bucket level (i.e., bucket 0) is recorded in EPROM 144 at step 444, and normal processing is continued at 415.

Figure 12:
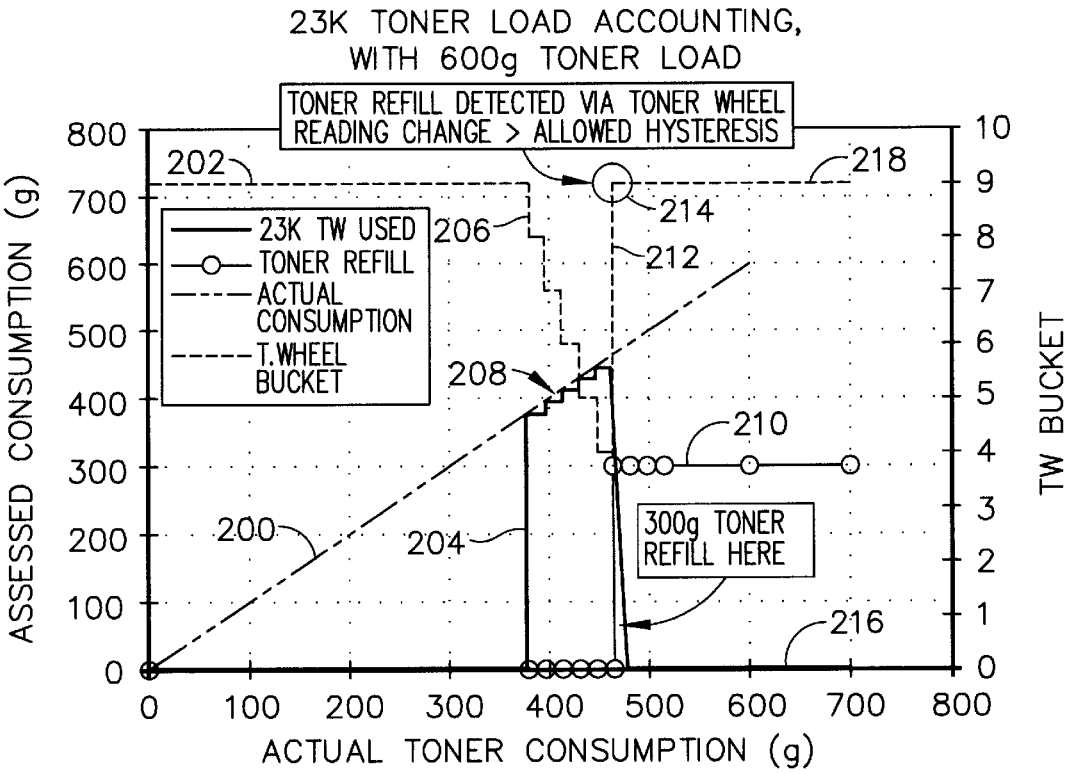
FIG. 12 is a graph showing various parameters of the subroutine depicted in the flow chart of FIG. 9.

FIG. 12 graphically shows the condition indicated by the flow chart of FIG. 9 by charting the actual toner consumption along the X-axis, vs. the "assessed" toner consumption along the Y-axis. The sloped line 200 indicates the actual toner consumption on this graph. On FIG. 12, it is assumed that a large process cartridge is being used which contains approximately 600 grams of toner material, and is also referred to as a 23K toner load accounting, which is an indication that this process cartridge should be able to print about 23,000 pages using its internal toner material.

The line designated by reference numeral 204 represents the amount of toner material already consumed, based upon indications by toner wheel 170. As can be seen on FIG. 12, there is no indication of toner usage based upon the toner wheel until approximately 378 grams of toner material have been consumed. At this point, the toner wheel becomes a reliable indicator of the remaining toner material left in reservoir 112, and the first bucket transition occurs from level 9 to bucket level 8. The bucket levels are graphically shown at the line 202. This first bucket level transition is indicated at the numeral 206 on FIG. 12.

Once the toner wheel becomes effectively operational, it becomes a reliable indicator of the actual consumption in the region of the graph designated by the reference numeral 208. At this point along the X-axis, the bucket level transitions will take place at regular intervals. If, for example, 300 grams of new toner material is refilled into the toner reservoir 112 after the bucket level 3 has been reached, then the toner wheel indicator will fall back to zero (0) for the "assessed" consumption (i.e., the Y-axis value), and the bucket level indication will jump back to level 9, along the line 212 on FIG. 12. The 300 gram toner refill is indicated by a line 210 on FIG. 12.

Once this 300 gram toner refill has occurred, the toner wheel indicator will stay at zero, as indicated by the line 216, and the bucket level will remain at 9 as indicated by the line 218. If the process cartridge is a non-reusable cartridge, then this will be an impermissible refill of toner material into process cartridge 100. In that situation, since the bucket level transition was at least a six level increase, step 432 will tell RIP 150 that a non-reusable refill has occurred, which is graphically indicated by the circle 214 on FIG. 12. In this situation, an error state is declared at step 435 on FIG. 9, and the printer 10 will lock-out this particular process cartridge 100 from operating.

Figure 10:
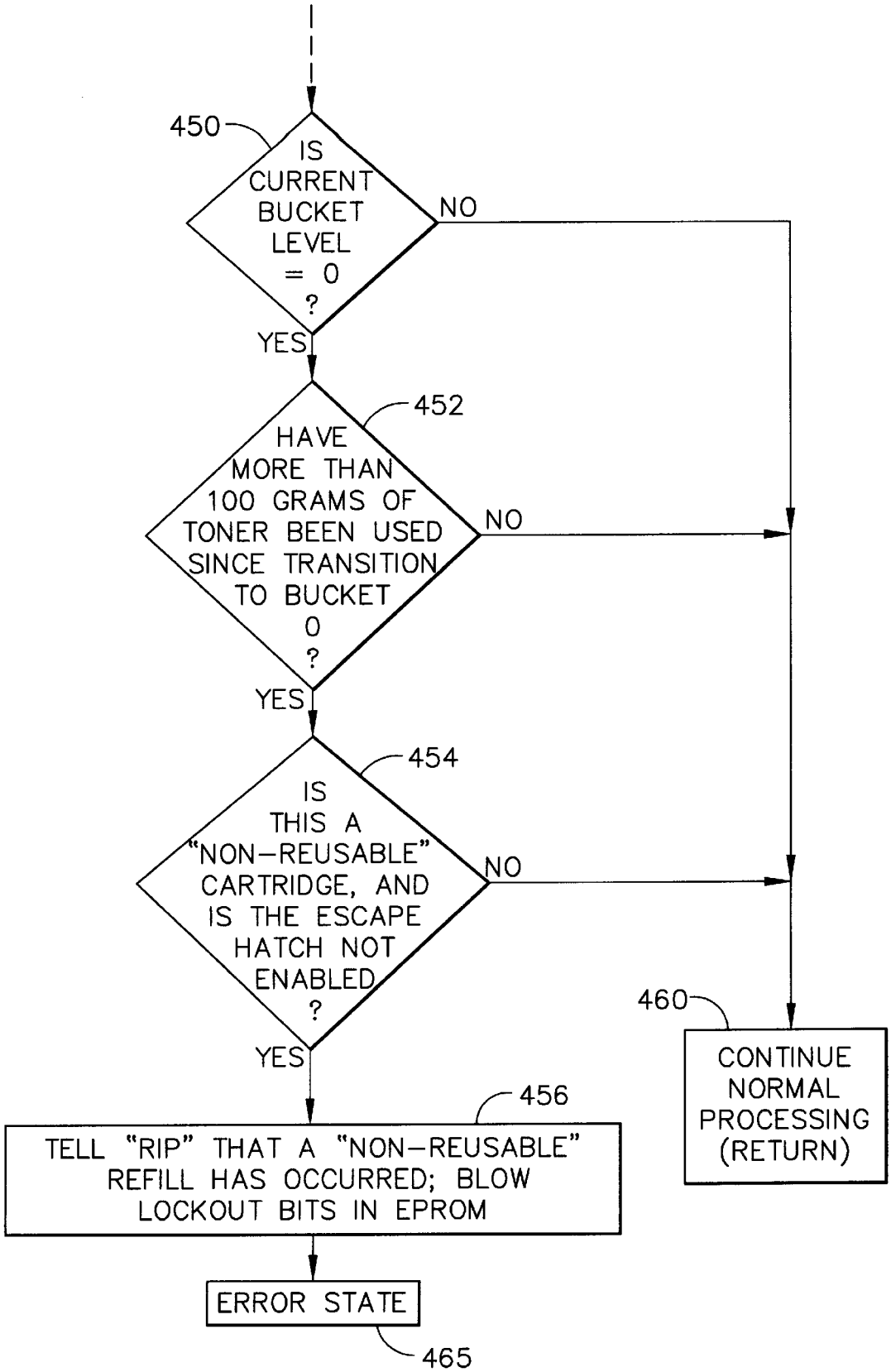
FIG. 10 is a flow chart of the subroutine that determines if the process cartridge of FIG. 2 has experienced a toner refill after the toner reservoir was almost empty.

FIG. 10 is another flow chart that determines a different error state under certain conditions. If the toner wheel has been tampered with, thereby causing the process cartridge 100 to appear "empty" but never reaching a situation where the printer literally runs out of toner material, then the toner tally will operate as a backup method to declare an error state and "lock out" a particular process cartridge. Starting at a decision step 450, during printing it is determined if the current bucket level is equal to zero (0). If the answer is NO, the logic flow is directed to a step 460 where normal processing continues and returns from this subroutine. If the answer is YES, a decision step 452 determines whether or not more than 100 grams of toner have been used since the transition of bucket level 1 to bucket level 0 has occurred.

This decision at step 452 as to whether 100 grams of toner have been used or not is based upon the toner tally which, as noted above, is proportional to the number of pels that have been printed by this process cartridge. Furthermore, this is a conservative 100 gram measurement, since the toner tally uses an internal factor of two-thirds so that, in actuality, it is more likely that 150 grams of toner material has actually been used, rather than merely 100 grams.

If the answer at step 452 was NO, the logic flow is directed to step 460 where normal processing is continued. If the answer is YES, the logic flow is directed to a decision step 454. Step 454 determines whether or not the process cartridge 100 is a non-reusable cartridge, and also whether or not the "escape hatch" has been left inactive. If the answer is NO to both questions, then normal processing continues at step 460. If the answer is YES (i.e., this is a non-reusable cartridge and the escape hatch is not enabled), then a step 456 tells the RIP 150 that a non-reusable refill has occurred. Step 456 also bums the "lockout" bits in EPROM 144. In this situation, the bits that are burned (or blown) in the EPROM memory elements 180 are bits 0 and 5 of byte 0, on Page 2. After that has occurred, the logic flow is directed to a step 465 which declares an error state, and printer 10 will cease operating with this particular process cartridge 100.

Figure 13:
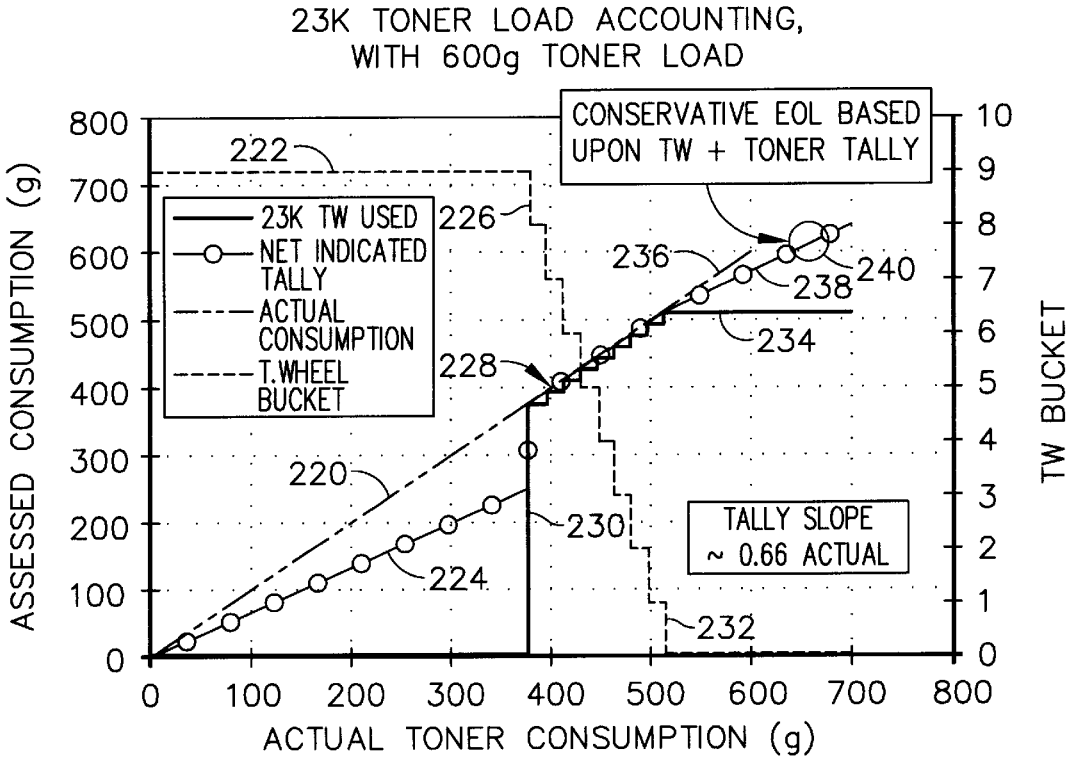
FIG. 13 is a graph showing various parameters of the subroutine depicted in the flow chart of FIG. 10.

FIG. 13 is a graph showing the situation that occurs after bucket level zero (0) is reached based on the toner wheel indications, and then after which the printer continues to operate well beyond the point where the initial toner load should have been exhausted. In FIG. 13 the sloped line 220 indicates the printer's toner consumption which, if the Y-axis values indicating "assessed consumption" were precisely correct, would always give a line having a slope of 45 degrees with respect to the X-axis (which represents actual toner consumption).

The signals provided by the toner wheel are indicated by a graph 230, which indicates that toner wheel 170 does not respond at all until a certain amount of toner has been consumed. As in the similar graph on FIG. 12, the toner wheel signal does not begin to provide an accurate indication until the remaining quantity of toner material has fallen to around 220 grams. As the toner wheel begins to provide a signal that indicates that other than a full toner reservoir 112 exists, then the bucket level transitions can begin to occur. At first the bucket level remains at its maximum level (i.e., at bucket 9) as indicated by the line 222. During this time, the toner tally is indicated by the sloped line 224, which (as related above) has a factor of two-thirds with respect to the probable actual consumption of toner material. This rather conservative estimate of the toner consumption as indicated by the toner tally insures that certain disabling operational results do not occur until well after the point that such operational decisions realistically should be taken.

When the actual toner consumption reaches about 378 grams out of 600 gram toner load the bucket level transition occurs from bucket 9 to bucket 8, as indicated by the line segment 226. When that occurs, the toner tally can now be corrected to take into account the signal provided by the toner wheel sensor 172 of actual remaining toner material left inside the reservoir 112. As soon as that occurs, the toner tally is corrected to the actual toner material remaining (according to the toner wheel gas gauge), and several such corrections take place, once at each bucket level transition, as indicated by the stepped line segments at 228 on FIG. 13.

As the actual toner consumption increases along line 220, the toner bucket levels will continue to decrease, until finally reaching the transition from bucket level 1 to bucket level 0, which occurs at line segment 232. Once that occurs, the signal from the toner wheel levels out, as seen on the horizontal line 234 on FIG. 13. In that situation, the toner tally can no longer be corrected to an "actual" physical value, so the toner tally again continues to increase at only a two-thirds factor, as seen on line 238 on FIG. 13.

Since the actual toner consumption continues to rise at a 45 degree angle (this continuation is indicated at the line segment 236), it can be seen that the toner tally along line 238 diverges from the actual consumption at line 236. After the toner tally newly accumulates an estimated 100 grams of toner usage, decision step 452 (see FIG. 10) causes a non-reusable cartridge to become locked out from operating with a printer. This lock-out operation occurs at the circle 240 on FIG. 13. Of course, a new load of toner material must have been placed within the toner reservoir 112 of this process cartridge 100. Otherwise, the actual load of toner material originally placed in the cartridge would have long ago since run out and the printer would not have been able to print up to this point. This can be seen on FIG. 13, since the bucket transition from bucket level 1 to bucket level 0 occurs approximately at 85 grams of remaining toner material. Obviously, another 100 grams (at a conservative accounting) could not have been further consumed through the process cartridge and print engine if additional toner material had not been added to this non-reusable cartridge, accompanied by tampering with the toner wheel to prohibit transition out of bucket 0.

On FIG. 13, the notation "EOL" stands for "End Of Life" of the process cartridge.

The indication "TW" stands for "Toner Wheel" signals. FIG. 13 also indicates that the toner tally slope is approximately 0.66 of actual toner consumption, which is the two-thirds factor that was discussed above.

Figure 11:
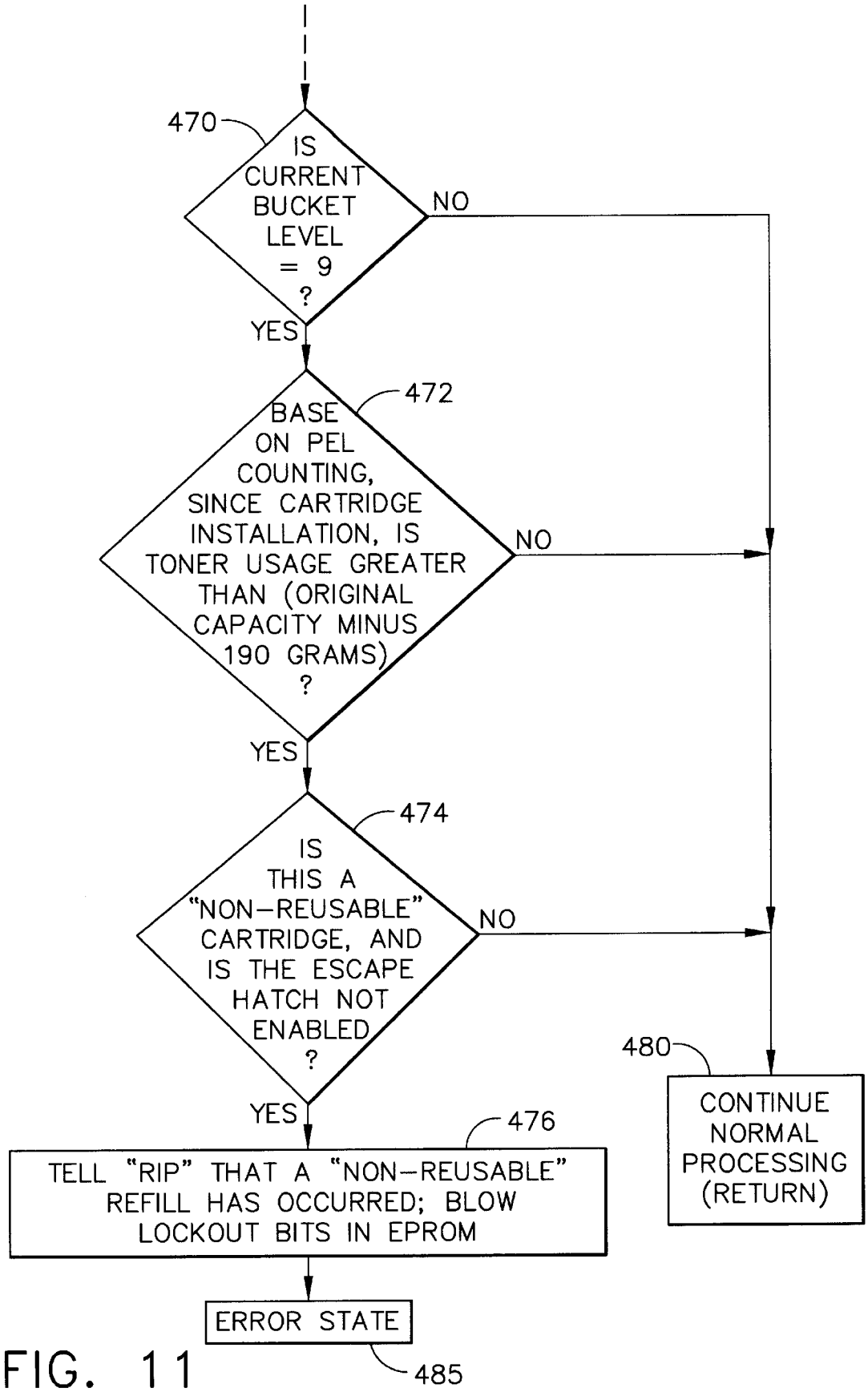
FIG. 11 is a flow chart of the subroutine that determines if the toner wheel sensor of the process cartridge of FIG. 2 has been disabled, while toner is consumed via printing operations.

FIG. 11 is a flow chart of a function that will ultimately prevent a process cartridge from operating with a printer if the toner wheel is tampered with before even the first bucket transition takes place (i.e., the transition from bucket level 9 to bucket level 8). Starting at a decision step 470, during printing, step 470 determines if the current bucket level is equal to level 9. If the answer is NO, the logic flow is directed to a step 480 which continues normal processing and returns from this subroutine. If the answer is YES, the logic flow is directed to a decision step 472.

At step 472, based on pel counting since cartridge installation, it is determined whether or not the toner usage is greater than the cartridge's original capacity minus 190 grams. The pel counting referred to above is based upon the toner tally, which includes a two-thirds factor so as to provide a very conservative approach to this determination. In a 600 gram cartridge, the result of this decision would change state after about 410 grams of toner had been consumed, according to the toner tally. In reality, since the toner tally is based on a two-thirds factor, the actual toner consumption was probably 615 grams. Since that amount of toner usage would be quite impossible unless the toner reservoir 112 had been refilled, the 410 gram point is a very conservative estimate to determine whether or not the bucket level should have changed from level 9 to bucket level 8 by this time.

If the answer was NO at decision step 472, then normal processing is continued at step 480. If the result was YES at step 472, then a decision step 474 determines both whether or not this is a non-reusable cartridge, and whether or not the escape hatch has been left inactive. If the answer to both questions is NO, then normal processing is continued at step 480.

If the result is YES at step 474 (i.e., the process cartridge 100 is a non-reusable cartridge and the escape hatch has not been enabled), then a step 476 tells the RIP 150 that a non-reusable refill has occurred. Step 476 also will burn the lockout bits in EPROM 144. The bits that are blown are bits 0 and 6 of byte 0, of Page 2 in the EPROM registers 180. After that has occurred, the logic flow enters an error state at a step 485, which disables the operation of this particular process cartridge 100 within printer 10.

Figure 14:
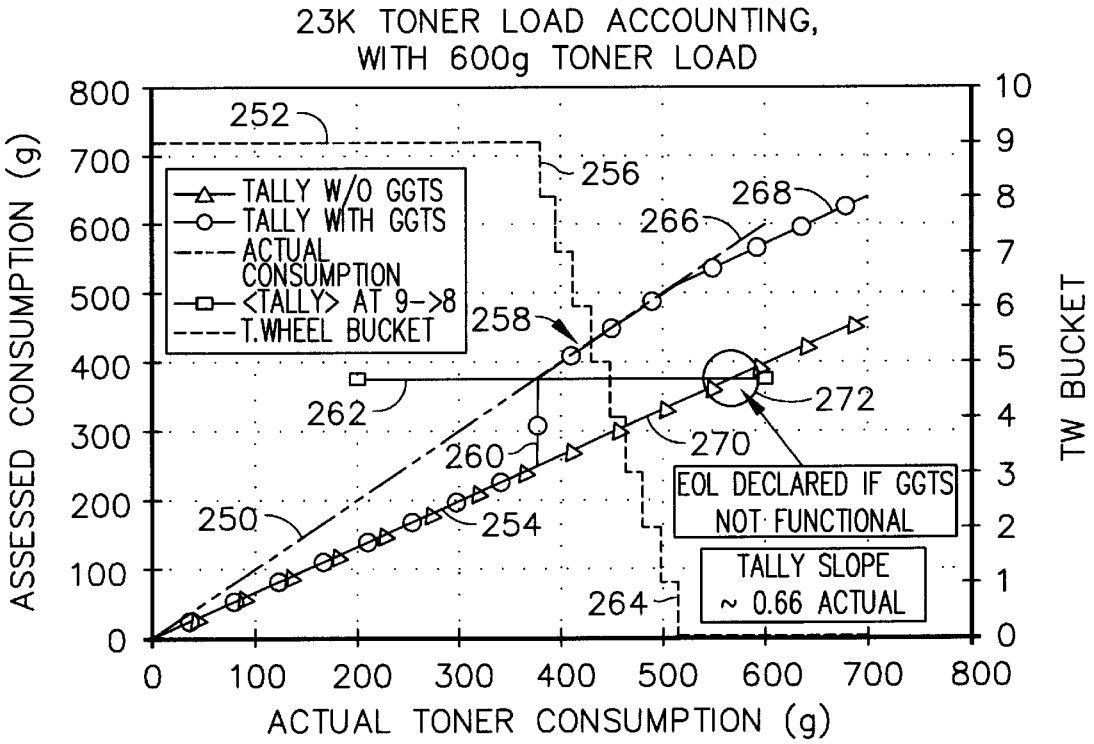
FIG. 14 is a graph showing various parameters of the subroutine depicted in the flow chart of FIG. 11.

FIG. 14 is a graph representing some of the signals involved with determining whether or not the toner wheel has been tampered with, such that detection of a bucket level 9 to a bucket level 8 transition is prevented. Assuming that a 600 gram toner load is the initial quantity of toner material placed into reservoir 112, it would not be expected that the toner wheel would begin to give reliable signals that produce bucket transitions until after about 378 grams of toner had been consumed through the process cartridge 100. As related above, the toner bucket level starts at level 9, and remains at level 9 until the toner wheel begins to provide signals indicating a change in the amount of toner remaining in the cartridge, as indicated at the line 252. If the gas gauge toner sensor 172 is functional, then bucket transitions should start occurring at the line segment 256 at the time the actual toner consumption has reduced the remaining quantity of toner material to about 221 grams, as seen on the actual toner consumption line 250 on FIG. 14.

The toner tally line 254 has a slope of only two-thirds of the 45 degree angle slope of the actual toner consumption line 250 on this X-axis and Y-axis scale. If the toner wheel is functional, the toner tally will jump from its two-thirds slope line (i.e., line 254) to the 45 degree angle actual consumption line 250 at the vertical line segment 260. The point of intersection between lines 250 and 260 provides a Y-axis value indicated by the horizontal line 262.

If the toner tally line 254 is extended past the point where the toner bucket transitions should begin to take place (i.e., at the X-axis position indicated by the vertical line 260), then the line segment 270 continues to tally the number of pels of toner that have been consumed at the two-thirds slope rate of the actual toner consumption. If no bucket transitions have occurred (i.e., if bucket level 9 is still the current bucket level) at the time that the line 270 intersects the line 262, then an end-of-life error state (EOL) is declared at that point, which is indicated by the circle 272 on FIG. 14.

As can be seen on FIG. 14, if the gas gauge toner sensor 172 remained functional, then the bucket level transitions would take place all the way down to the transition to bucket level zero at the line segment 264, and this would take place well before the end of life error state is declared at the circle 272.

As noted above, if the gas gauge toner sensor remained functional, then the toner tally would be repeatedly corrected once the bucket levels began to make transitions, and the toner tally would be closely aligned to the actual toner consumption along the line 258. As the toner consumption continued to take place, the actual consumption line 266 would diverge from the toner tally line 268 only at the point where the bucket transitions reached the level of bucket 0. Of course, if the toner material were completely expended, then the process cartridge 100 would obviously have to be replaced in order to make printer 10 functional.

The error state 485 on FIG. 11 only can occur if the toner wheel 170 is non-functional, which would typically take place only if the toner wheel had been tampered with. This end of life error state is declared only when it has become quite evident that, not only the toner wheel failed, but also that the quantity of toner material remaining within reservoir 112 would be so low as to make the print output on actual sheets of print media visually appear to be quite defective because of lack of toner. Even if some toner material remained, there would not be a sufficient quantity to be properly developed and placed properly onto the PC drum for a true rendition printer's output.

It will be understood that many of the features described hereinabove can be modified without departing from the principles of the present invention. For example, the number of toner refills in a reusable cartridge can be tracked and stored in the EPROM 144, however, it is preferred that only the first refill be recorded in EPROM 144 using the currently available Dallas Semiconductor part. A "refill" bit is burned in the EPROM, and that information is used for machine/printer usage purposes.

As another example, the data stored in Page 1 of the EPROM registers 180 are written to at the time of manufacturing, including the life usage of the process cartridge components. The types and form of such information can be easily changed to meet various customer requirements, or to track other types of machine/customer usage history, as required. As discussed above, some of the lock-out and machine features can be disabled by user or manufacturing inputs, referred to above as "escape hatches." The enabling or disabling of these several disparate functions for a printer is in itself a new feature, thereby providing the user or manufacturer of the printer with much greater flexibility. In the preferred embodiment, the escape hatches are functions that are initially programmed by the manufacturer of the printer (e.g., a manufacturer such as Lexmark International, Inc.). During the manufacturing process, the EPROM 144 will have its escape hatch bits either blown to their Logic 0 states, or left in their Logic 1 states, as desired by the prospective customer/user of the printer. Since Page 1 of the EPROM registers 180 becomes write-protected at the manufacturing stage, these escape hatch bits cannot later be changed.

As noted above, the preferred embodiment of the present invention provides a printer having several disparate functions, and it could be desirable to allow the user to disable one or more of these disparate functions. If that is the case, then the escape hatch bits could be placed at a different memory register in EPROM 144, preferably in a page that was not write-protected at the time of manufacturing. For example, the EPROM used on the process cartridge could have its memory map altered to accommodate this change in escape hatch registers, or more likely, the EPROM chip 144 itself could bc upgraded to a larger size, such as a 4K or a 16K bit chip (instead of the 1K bit chip used in the present invention), and there would be much more memory space to relocate the escape hatch bits. In this alternate embodiment, a particular user who does not want, for example, any machine data gathered and stored into EPROM 144, then the "machine data escape hatch" is made accessible to the user, so that, if enabled (by either the user or by the factory), the machine data will not be collected (see step 360 on FIG. 8).

So long as the machine data functions are not disabled, the user can observe certain machine-related messages concerning the printer. For example, the number of refilled cartridges that have been installed at this particular printer over its lifetime is available as part of the machine information, specifically at Page 3, bytes 22 of EPROM 144. This information is written into the EPROM at the 20 gram use point, as described above. Other information sent by the printer to the EPROM at that point include the printer serial number, printer date of manufacturing, the printer's "permanent page count," and the printer's "permanent cycle count" (which is the toner wheel rotation count).

As was related above, one chief advantage of the present invention is that the toner wheel and "gas gauge toner sensor" combination allow the printer to, with sufficient confidence, be able to make important decisions that relate to the amount of toner usage from a process cartridge. In other words, the printer is not merely relying upon some accumulated count of pels or pixels that have been printed, without knowing in reality whether or not those pels were "dark" or "light" pels. The bucket level changes are based upon a measured quantity, not a mere accumulated pixel or pel count. Based upon this more accurate information, the printer can make realistic decisions about whether or not to declare that a process cartridge has reached the end of its life in the case of a non-reusable cartridge.

One reason it is significant to make life expectancy decisions based upon a measured quantity of remaining toner versus the use of an accumulated toner pel count is that the customer can change certain of the settings that affect the toner consumption per pel, such as the print resolution, print darkness, and whether or not a toner saver mode is used. Moreover, there are uncontrolled factors that have significant tolerances that affect the toner consumption per pel. These factors include the printhead spot size, printhead exposure, developer bias voltage, the printer operating temperature and humidity, the printer job mix and run rate, the photoconductor sensitivity and residual voltage, the developer roll coating thickness and surface roughness, the doctor blade force and roughness, and the print pattern including the center and edge pel differences. All of these factors, especially when accumulated with their various tolerances, can lead to a very misleading result if a printer relies strictly upon an assumed amount of toner usage per pel printed.

The only time that the printer of the present invention relies strictly upon an accumulated pel or pixel count is when the bucket gradation level never changes from its "full" level at bucket 9. Even in that scenario, the toner wheel and gas gauge toner sensor are relied upon to a certain extent; the printer knows that the gas gauge levels should begin to change by the time a certain amount of toner material is used. Since a very conservative estimate of toner usage is used in making the end of life decision, the printer can be assured that the toner wheel has either been tampered with, or was non-functional from the start, before making the decision to declare the "end of life" (EOL) and lock-out this particular process cartridge. The toner tally preferably is stored in the NVRAM of printer 10, so that if power fails or the printer is turned off, the accumulated toner tally will not be lost. In the preferred embodiment, the toner tally is not counted or tallied within the EPROM 144 on the process cartridge 100.

The major advantage of these features is that the quantity of remaining toner material is directly measured when making the bucket level transitions, and the printer is not relying upon empirical data to estimate the amount of toner usage based upon user-entered printing parameters. Furthermore, the toner gas gauge is accurate throughout a critical range of toner usage, and is not relying upon multiple optical sensors or other types of toner-detecting devices to determine remaining quantities of toner material that continue to decrease.

As can be seen from a close inspection of Table #1, the "machine data" stored onto the EPROM 144 includes a variety of types of information. Some of the data includes an "encoded value" of recent printer errors. Several of these printer errors can be stored on the EPROM, which in effect provides an error log for the printer. As noted above, the printer's serial number and date of manufacture are stored on the EPROM along with a permanent page count and a permanent cycle count of the printer. The number of process cartridges installed in the printer by capacity is also stored, as well as the number of process cartridges that have been installed which were refills. The PCI slot description is stored along with the type of display language. Other information is also stored, including the darkness level and printer resolution used by the printer, and also whether or not the printer operates in the duplex mode. It will be understood that other types of printer usage data could also be stored in EPROM 144 without departing from the principles of the present invention.

Other examples of such escape hatches involve whether or not the printer will be locked out from operating with a particular process cartridge. Such lock-out conditions include: the "Project ID lock-out" that requires a specific Project ID (Uniqueware) or Custom ID (Laser ROM) to be read when the process cartridge is mounted to the printer (see step 310 on FIG. 7); the "bucket transition lock-out" that prevents a non-reusable cartridge from being used after a refill when a six-bucket transition of the toner gas gauge sensor is detected (see step 430 on FIG. 9); the "cartridge empty too long lock-out" that prevents a non-reusable cartridge from being reused if the process cartridge always appears to be empty based upon the toner tally counting method (see step 454 on FIG. 10), but nevertheless continues to operate; and the "cartridge full too long lock-out" which prevents a non-reusable cartridge from being reused if the toner wheel is tampered with such that the cartridge always appears to be full based upon the toner wheel gas gauge method (see step 474 on FIG. 11).

Another "escape hatch" can also involve the configuration and OEM keys, which allows the printer to be configured based upon data within the memory device on the process cartridge. Examples of information that will be used by the printer to alter operating characteristics includes: the PC drum type, toner capacity, non-reusable identification, operating point offsets, etc. It will be understood that other types of "escape hatches" could be provided to enable or disable particular disparate functions of a printer without departing from the principles of the present invention.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. A method for storing data on a non-volatile memory device in an image forming apparatus, said method comprising:

(a) providing an image forming apparatus main body that contains a memory circuit, a print engine, and a processing circuit that controls the routing of data between said memory circuit and said print engine;

(b) providing a detachable process cartridge that contains a non-volatile memory device, a toner reservoir, and a toner level sensing circuit, wherein said toner level sensing circuit providing an output that exhibits more than two discrete gradation levels that are related to a measured remaining quantity of toner material in said toner reservoir; and (c) changing the state of a bit in said non-volatile memory upon the occurrence of a transition between two of said discrete gradation levels of the output of said toner level sensing circuit based upon the measured remaining quantity of toner material in said toner reservoir.

2. The method as recited in claim 1, wherein said changing the state of a bit in said non-volatile memory is irreversible.

3. The method as recited in claim 1, wherein said non-volatile memory comprises an EPROM with its UV window permanently covered.

4. The method as recited in claim 1, wherein said toner level sensing circuit comprises a rotatable toner wheel, an optoelectronic sensor, and an electronic gradation level determining circuit, said toner wheel rotating at a rate that varies as the measured remaining quantity of toner material in said toner reservoir varies.

5. The method as recited in claim 1, further comprising locking out said process cartridge from operating with said image forming apparatus main body when one of a plurality of operational events occurs.

6. The method as recited in claim 5, wherein one of said plurality of operational events locks out said process cartridge when a refilling of toner material into said toner reservoir is detected.

7. The method as recited in claim 5, wherein one of said plurality of operational events locks out said process cartridge when a first of said one of a plurality of discrete level transitions does not occur by the time that a pre-determined number of pels has been produced by said print engine.

8. The method as recited in claim 7, wherein said pre-determined number of pels is accumulated by said processing and memory circuits at a multiplying factor of 0.66.

9. The method as recited in claim 5, wherein one of said plurality of operational events locks out said process cartridge when greater than a predetermined number of pels has been produced by said print engine after the final of said plurality of discrete level transitions has occurred.

10. The method as recited in claim 9, wherein said pre-determined number of pels is accumulated by said processing and memory circuits at a multiplying factor of 0.66.

11. The method as recited in claim 5, wherein said process cartridge comprises a non-reusable cartridge.

12. The method as recited in claim 11, further comprising inspecting an escape hatch data bit in said memory circuit to determine whether or not said one of a plurality of operational events will be configured to lock out said process cartridge from operating with said image forming apparatus main body.

13. The method as recited in claim 5, wherein said process cartridge comprises a reusable cartridge.

14. A method for storing data on a non-volatile memory device in an image forming apparatus, said method comprising:

(a) providing an image forming apparatus main body that contains a memory circuit, a print engine, and a processing circuit that controls the routing of data between said memory circuit and said print engine;

(b) providing a detachable process cartridge that contains a non-volatile memory device and a toner reservoir;

(c) burning at least one bit of said non-volatile memory after a pre-determined amount of pels have been printed to establish a that a valid installation of said process cartridge in said image forming apparatus main body has occurred; and (d) recording machine data relating to usage history, substantially when said valid installation occurs.

15. The method as recited in claim 14, wherein said machine data comprises at least one of printer usage history information and process cartridge usage history information.

16. The method as recited in claim 14, wherein said pre-determined number of pels is accumulated by said processing and memory circuits at a multiplying factor of 0.66.

17. The method as recited in claim 14, further comprising inspecting an escape hatch data bit in said memory circuit to determine whether or not said machine data will be recorded in said non-volatile memory.

18. A method for operating an image forming apparatus, said method comprising the steps of:

(a) providing an image forming apparatus that contains a memory circuit, a print engine, and a processing circuit that controls the routing of data between said memory circuit and said print engine;

(b) inspecting at least one escape hatch data bit in said memory circuit to determine whether at least one of a plurality of disparate functions will be enabled or disabled within said image forming apparatus.

19. The method as recited in claim 18, wherein said plurality of disparate functions comprises: (a) collecting machine data, (b) testing for memory chip project identification number, (c) using configuration page data, and (d) disabling process cartridge lock-out functions.

20. The method as recited in claim 18, wherein said at least one escape hatch is user selectable.

21. The method as recited in claim 18, wherein said at least one escape hatch is selected at the time of cartridge manufacturing.

22. A method for storing data on a non-volatile memory device in an image forming apparatus, said method comprising the steps of:

(a) providing an image forming apparatus main body that contains a memory circuit, a print engine, and a processing circuit that controls the routing of data between said memory circuit and said print engine;

(b) providing a detachable process cartridge that contains a non-volatile memory device, a toner reservoir, and a toner level sensing circuit that provides an output signal which indicates more than two discrete output quantities that are related to a measured quantity of toner material remaining in said toner reservoir; and (c) burning a bit of said non-volatile memory upon the occurrence of said toner level sensing circuit's said output signal changing from one discrete output quantity to another.

23. The method as recited in claim 22, wherein said plurality of discrete output quantities comprises bucket levels from 9 to 0, inclusive.

24. The method as recited in claim 22, wherein said changing the state of a bit in said non-volatile memory is irreversible.

25. The method as recited in claim 22, wherein said non-volatile memory comprises an EPROM with its UV window permanently covered.

26. The method as recited in claim 22, wherein said toner level sensor comprises a rotatable toner wheel and an optoelectronic sensor, said toner wheel rotating at a rate that varies as the measured remaining quantity of toner material in said toner reservoir varies.

27. The method as recited in claim 22, further comprising locking out said process cartridge from operating with said image forming apparatus main body when one of a plurality of operational events occurs.

28. The method as recited in claim 27, wherein one of said plurality of operational events locks out said process cartridge when a refilling of toner material into said toner reservoir is detected.

29. The method as recited in claim 27, wherein one of said plurality of operational events locks out said process cartridge when a first of said one of a plurality of discrete level transitions does not occur by the time that a pre-determined number of pels has been produced by said print engine.

30. The method as recited in claim 29, wherein said pre-determined number of pels is accumulated by said processing and memory circuits at a multiplying factor of 0.66.

31. The method as recited in claim 27, wherein one of said plurality of operational events locks out said process cartridge when greater than a pre-determined number of pels has been produced by said print engine after the final of said plurality of discrete level transitions has occurred.

32. The method as recited in claim 31, wherein said predetermined number of pels is accumulated by said processing and memory circuits at a multiplying factor of 0.66.

33. The method as recited in claim 27, wherein said process cartridge comprises a non-reusable cartridge.

34. The method as recited in claim 33, further comprising inspecting an escape hatch data bit in said memory circuit to determine whether or not said one of a plurality of operational events will be configured to lock out said process cartridge from operating with said image forming apparatus main body.

35. The method as recited in claim 27, wherein said process cartridge comprises a reusable cartridge.

36. An image forming apparatus, comprising:

(a) a memory circuit for storage of data;

(b) a detachable process cartridge that contains a non-volatile memory device, a toner reservoir, and a toner level sensing circuit that provides an output signal which indicates more than two discrete output quantities that are related to a measured quantity of toner material remaining in said toner reservoir;

(c) a print engine that produces a physical output upon a print media; and (d) a processing circuit that is configured to control the flow of data between said memory circuit, process cartridge, and print engine, said processing circuit also being configured to set a bit of said non-volatile memory device upon the occurrence of said toner level sensing circuit's said output signal changing from one discrete output quantity to another.

37. The image forming apparatus as recited in claim 36, wherein said plurality of discrete output quantities comprises bucket levels from 9 to 0, inclusive.

38. The image forming apparatus as recited in claim 36, wherein said non-volatile memory is constructed such that changing the state of a bit is irreversible.

39. The image forming apparatus as recited in claim 36, wherein said non-volatile memory comprises an EPROM with its UV window permanently covered.

40. The image forming apparatus as recited in claim 36, wherein said toner level sensor comprises a rotatable toner wheel and an optoelectronic sensor, said toner wheel rotating at a rate that varies as the measured remaining quantity of toner material in said toner reservoir vanes.

41. The image forming apparatus as recited in claim 36, wherein said process cartridge is locked out from operating with said image forming apparatus when one of a plurality of operational events occurs.

42. The image forming apparatus as recited in claim 41, wherein said process cartridge comprises a non-reusable cartridge.

43. The image forming apparatus as recited in claim 41, wherein said process cartridge comprises a reusable cartridge.

* * * * *